US008733751B2

(12) United States Patent
Kagami et al.

(10) Patent No.: US 8,733,751 B2
(45) Date of Patent: May 27, 2014

(54) SHEET STACKING DEVICE AND SHEET FOLDING DEVICE

(75) Inventors: Toshiaki Kagami, Yamanashi-ken (JP); Shinichi Ito, Kofu (JP); Mizuho Shirakura, Fuefuki (JP)

(73) Assignee: Nisca Corporation, Minamikoma-gun, Yamanashi-ken (JP)

( * ) Notice: Subject to any disclaimer, the term of this patent is extended or adjusted under 35 U.S.C. 154(b) by 141 days.

(21) Appl. No.: 13/445,556

(22) Filed: Apr. 12, 2012

(65) Prior Publication Data

US 2012/0261872 A1 Oct. 18, 2012

(30) Foreign Application Priority Data

Apr. 13, 2011 (JP) ..... 2011-088958
Dec. 21, 2011 (JP) ..... 2011-279749

(51) Int. Cl.
*B65H 37/06* (2006.01)

(52) U.S. Cl.
USPC ..... 270/32; 270/45; 493/405; 493/416; 493/436

(58) Field of Classification Search
CPC ..... B65H 37/06
USPC ..... 270/32, 37, 45; 271/213, 315; 493/405, 493/416, 436
See application file for complete search history.

(56) References Cited

U.S. PATENT DOCUMENTS

| | | | | |
|---|---|---|---|---|
| 4,968,015 | A * | 11/1990 | Calverley et al. | 271/4.1 |
| 7,226,050 | B2 * | 6/2007 | Sekiyama et al. | 271/213 |
| 7,267,338 | B2 * | 9/2007 | Kuwata et al. | 271/213 |
| 7,631,859 | B2 * | 12/2009 | Milillo et al. | 270/58.07 |
| 7,712,732 | B2 * | 5/2010 | Horii et al. | 270/32 |
| 8,240,662 | B2 * | 8/2012 | Yahata | 271/207 |
| 2006/0180970 | A1 * | 8/2006 | Mimura et al. | 270/32 |
| 2007/0290427 | A1 * | 12/2007 | Horii et al. | 270/32 |
| 2009/0085281 | A1 * | 4/2009 | Milillo et al. | 271/187 |
| 2010/0244355 | A1 * | 9/2010 | Yoshida et al. | 271/3.14 |

FOREIGN PATENT DOCUMENTS

| | | |
|---|---|---|
| JP | 2004-284742 | 10/2004 |
| JP | 2006-076779 | 3/2006 |

* cited by examiner

*Primary Examiner* — Patrick Mackey
(74) *Attorney, Agent, or Firm* — Manabu Kanesaka

(57) ABSTRACT

According to the present invention, a stacking face (84) is inclined such that a downstream side in a sheet discharging direction is lower, and is composed of a first supporting face (84*a*) supporting a sheet to be stacked at its front end part in a sheet discharging direction and a second supporting face (84*b*) supporting the sheet to be stacked at its rear end part in the sheet discharging direction. The first supporting face (84*a*) is structured to be shorter than ½ of a minimum size length of the sheet to be stacked, and this is provided rotatably upward around a rotating shaft (85*x*) furnished to a registration part (85*r*) of regulating the front ends of the sheets. The first supporting face (84*a*) raises the front ends of the sheets to be discharged by rotation of the registration part (85*r*).

10 Claims, 23 Drawing Sheets

SHEET STACKING DEVICE AND SHEET FOLDING DEVICE

BACKGROUND OF THE INVENTION

1. Technical Field

The present invention relates to a sheet stacking device for stacking discharged sheets on a stacking part, and a sheet folding device furnished with the same.

2. Description of Related Arts

Conventionally, several kinds of sheets processed by a sheet processing device have been stacked and accommodated in a stacking part connected under an discharge port of the sheet processing device, and for example, Patent Documents 1 and 2 have processed the sheets into an inner three-fold or an outer three-fold at a folding processing part of the sheet folding device, and accommodated into the sheet folding device, and discharged into the stacking part connected under the discharge port of the sheet processing device for stacking and accommodating them.

Prior arts of devices are disclosed in Japanese patents application publication No. 2004-284742 (Patent Document 1) and Japanese patents application publication No. 2006-76779 (Patent Document 2).

However, in Patent Document 1 and Patent Document 2, since the stacking faces are flat, the stacked sheets are closely adhered to the stacking face, and when a user takes out the stacked sheets, no space exists between the stacking face and sheets for inserting the user's hands.

When stacking the sheets having several kinds of sizes on the stacking part, the stacking face must be the same as a maximum size, and in particular, in case stacking the sheets of a minimum size, stacking conditions are out of order, stacking of well matching is difficult.

As to the folded sheets, if discharging the sheets from the discharge port into the accommodating area in such a posture of the folded creases being front and rear at its end in a transferring direction as shown in FIG. 23, the sheets shaped in rectangular strip are sent into the accommodating area in the posture of a short side Sp being front and rear in the transferring direction, and drop in this posture.

Accordingly, in the sheet stacking tray at the bottom of the accommodating area, the folded sheets are stacked irregularly in a disorder condition. This condition is shown in FIG. 23, and the folded sheets dropped from the sheet discharge port go into an accommodating box under an Sa condition of the same, drop under an Sb condition, and are stacked irregularly under an Sc condition.

SUMMARY OF THE INVENTION

The present invention is to settle the above mentioned problems, and a first object is to offer such a device enabling to accommodate regularly the sheets discharged in order under a laminated condition, and enabling to easily take out the laminated sheets.

Further, for solving the above mentioned problems, an inventor of this invention has come to such a discovery of dropping the folded sheets carried out from the discharge port in a crossing direction with a sheet discharging direction along a regulating face disposed in front of the sheet discharging direction, and adopting a sheet discharging mechanism accommodated on the tray of the bottom, thereby to regulate and accommodate comparably uniformly the folded sheets in shape of the rectangular strip shape along a guide face from a lengthwise direction.

However, there has happened a problem that when dropping the folded sheets in shape of the rectangular strip along a guide face from the lengthwise direction to accommodate on the sheet stacking tray, the sheets are deformed or broken at lower ends owing to shocks of dropping.

Therefore, a second object of the invention is to offer a device causing no deformation or breakage in the ends of the sheets owing to shocks of dropping when accommodating.

Since the invention structures to incline a sheet stacking face such that the sheet discharging direction is lowered at the downstream, and the front end of the stacked sheets is regulated to a registration part, various kinds of stacked sheets are made uniform at ends of the sheets, and it is possible to stack the sheets with good registering property.

The folded sheets shaped in rectangular strip are dropped from a lengthwise direction onto the tray within the accommodating area along the regulated face, so that the folded sheets are accumulated in a comparatively stabilized direction. Thereby, the folded sheets can be accumulated in relatively uniform lamination.

With respect to the above mentioned first problem, the invention structures the device in a manner of rotating upward a first supporting face of supporting the front end in the sheet discharging direction of the stacked sheets, and therefore, when taking out the sheets, the user rotates the first supporting face and can lift up the sheet discharging direction at the front end.

Thereby, the stacked sheets closed to the first supporting face is lifted up, a space for the user to insert his hand can be secured, so that the sheets can be taken out owing to a simple structure.

Further, with respect to the second problem, a blade member is disposed rotatably in a dropping direction for knocking against and regulating the front end of the dropping sheets in the accommodating area.

Therefore, the sheets dropping onto the tray is moderately lowered at dropping speed, and the sheets dropping from the discharge port drop, not biasing the posture by the blade member. Due to such arrangements, no danger exist of damaging the sheets at the ends, and the sheets moderately drop keeping almost parallel balance.

Thus, the invention drops and accommodates the sheets folded in rectangular strip shape, following the sheet edges in the length along regulating face, and keeping moderate the sheet discharging posture with the blade member, so that the folded sheets can be regularly accumulated and accommodated in the accommodating area.

Together with it, the accommodating area can be made small sized (size of the folded sheets to be accommodated) with a large capacity (large head).

DETAILED DESCRIPTION OF THE INVENTION

Figure 1:
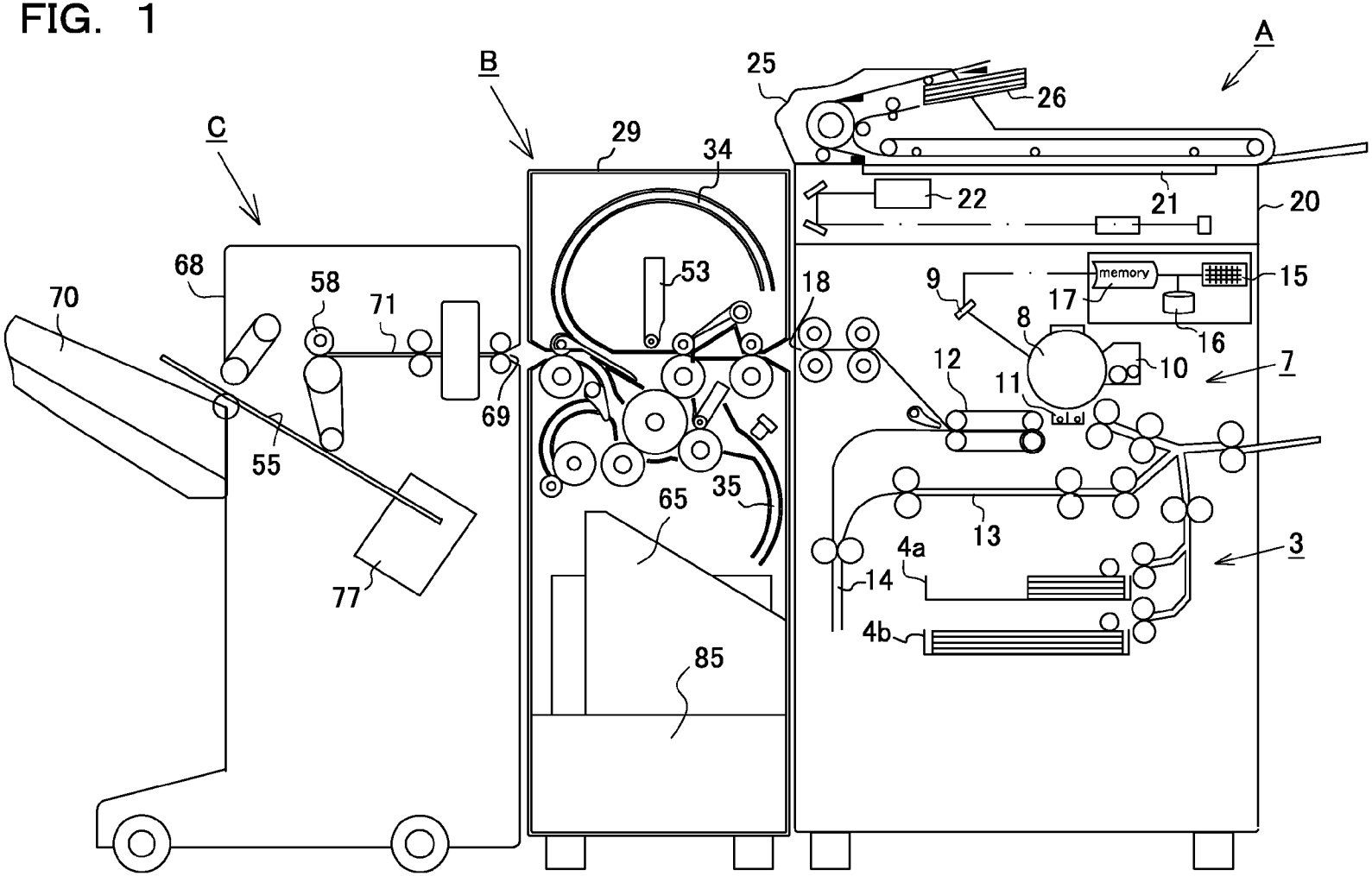
FIG. 1 An explanatory view of a whole structure of an image forming system having a sheet folding device according to the invention.

On the basis of embodiments shown under, the present invention will be stated in detail. FIG. 1 shows an image forming system having a sheet folding device according to the invention. This system is composed of an image forming device A, a sheet folding device B and a post-processing device C. The sheet having images formed in the image forming device A is folded in the sheet folding device B, and performed with a set copies-justification and bound in the post-processing device C.

[Image Forming System]

The image forming device A is composed in the order of a printer, copier and printing machine forming images in the sheet. The illustrated system as a compound-typed copier having a copying function and a printing function is composed of an image forming part 7, a document reading part 20 and a feeder part (document feeding device) 25. The sheet folding device B is connected to a sheet discharging port 18 of the image forming A, folds an image printed sheet, and transports to the post-processing device C.

The post-processing device C is connected to the carrying-out port 31 of the sheet folding device B, punches holes in the image printed or folded sheets, and post-processed with stamping or binding processing. In the following, explanation will be made in the order of the sheet folding device B, the image forming device A and the post-processing device C.

[Sheet Folding Device]

The sheet folding device B based on this invention is built in the image forming device A or the post-processing device C, otherwise this is structured as an independent device (stand-alone structure) of these devices. The shown device is arranged as an option unit between the image forming device A and the post-processing device C.

Figure 3:
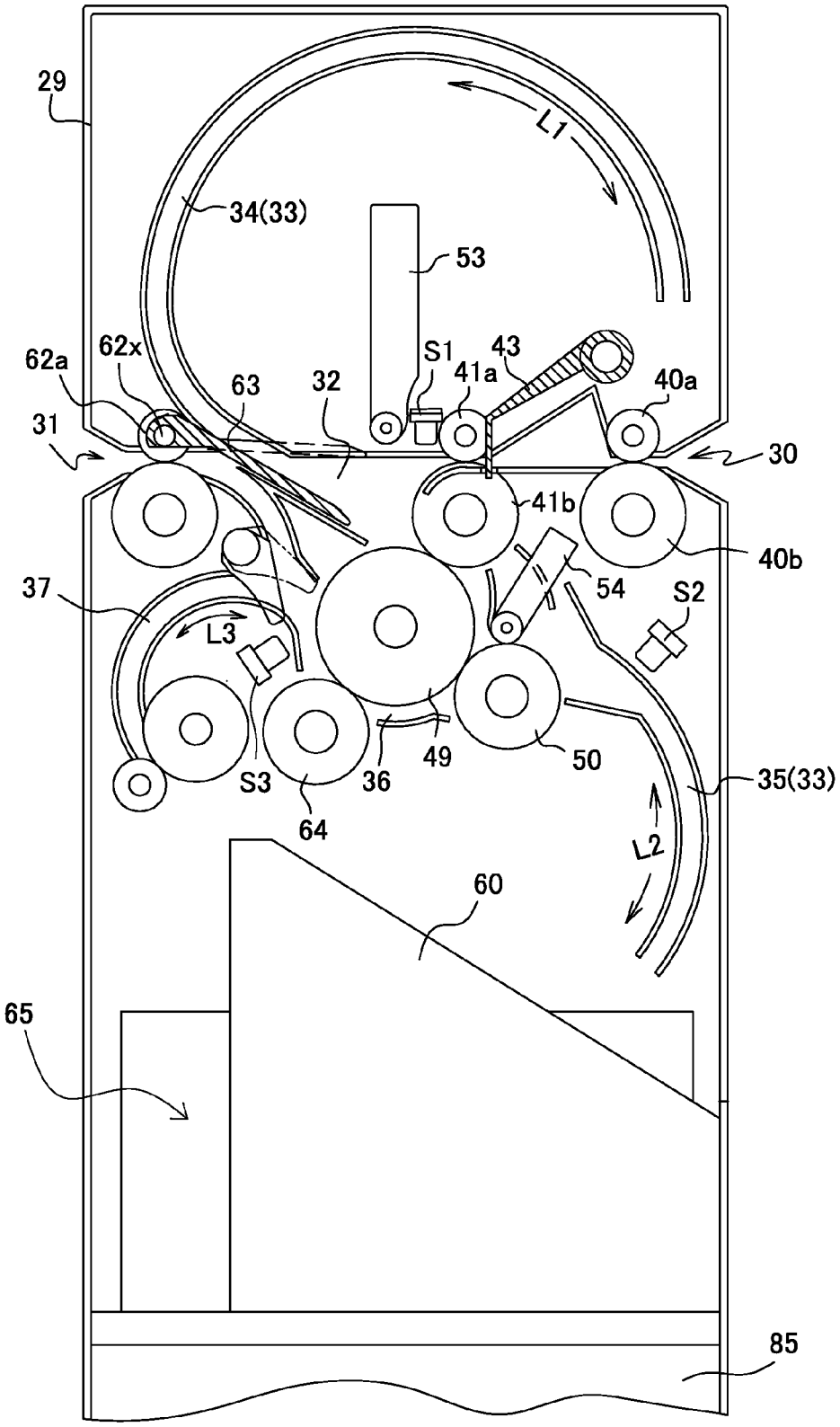
FIG. 3 An explanatory view of the whole structure of the sheet folding device in the system of FIG. 1.
Figure 4:
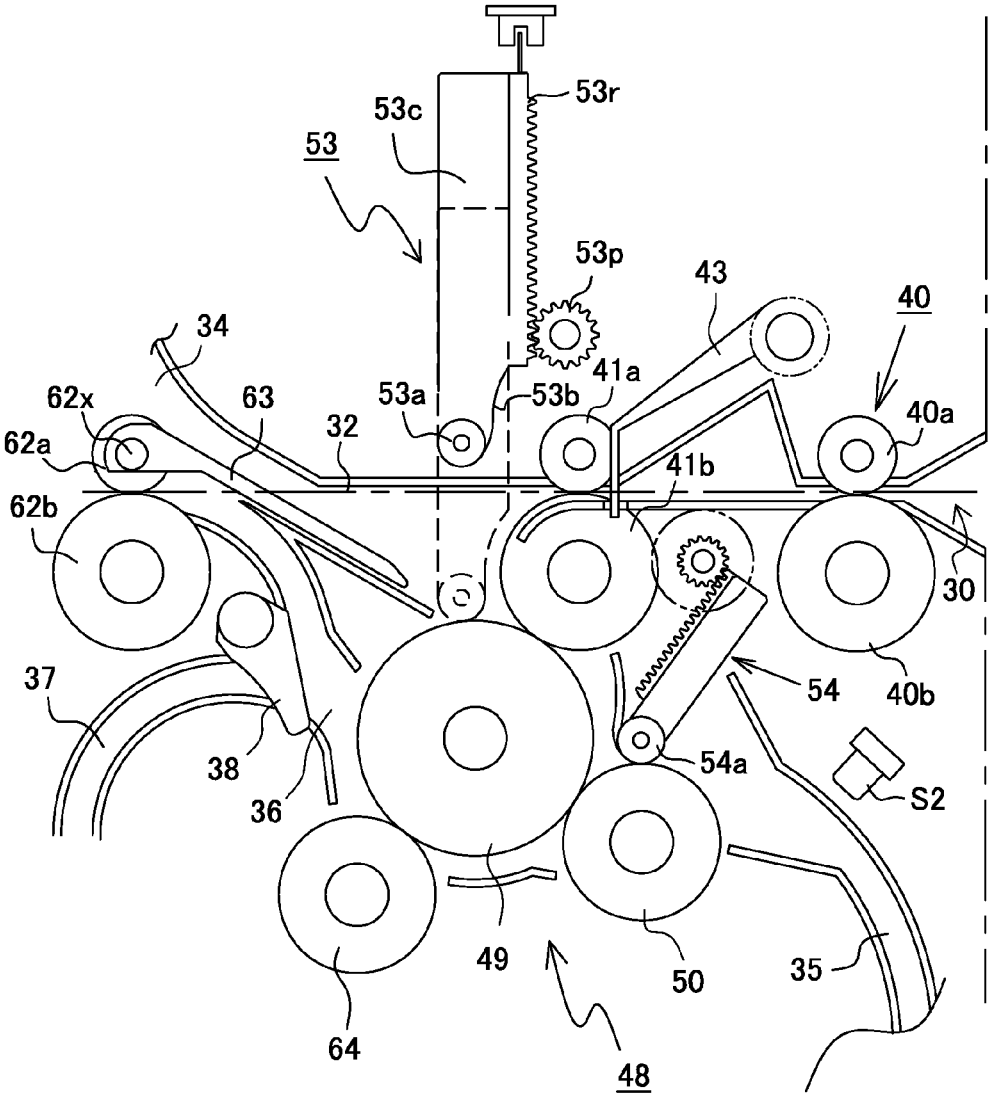
FIG. 4 An enlarged principal part of the sheet folding device of FIG. 3.

The sheet folding device B shows a whole structure in FIG. 3, and the device housing 29 has a carry-in port 30 and a carrying-out port 31. The carry-in port 30 is disposed at a place communicating with the sheet discharging port 18 of the main body of the image forming device A at an upstream side, while the carrying-out port 31 is disposed at a place communicating with an acceptance port 69 of the post-processing device C at a downstream side.

By the way, this invention may have such a case that the sheet folding device B does not have an independent device housing 29, but it may be build in a casing of the post-processing device C, and such a case does not need the carry-in port 30 and the carrying-out port 31. Accordingly, the carry-in port is the same meaning as a carry-in part, and the carrying-out port 31 is the same meaning as a carrying-out part. Conveniently, explanation will be made in a way of the carry-in part as the carry-in port 30 and the carrying-out port 31 as the discharge part.

As shown in FIG. 3, the carry-in port 30 and the carrying-out port 31 are arranged in opposition as crossing the device housing 29, and the shown carry-in port 30 and carrying-out port 31 are almost horizontally opposite. Between the carry-in port 30 and the carrying-out port 31, there are disposed a first transport path 32 and a second transport path 33, the first transport path 32 discharging the sheets to the carrying-out port 31 as not processing the sheets from the carry-in port 30, and the second transport path 33 carrying out the folding process of the sheets from the carry-in port 30 and carrying out to the carrying-out port 31.

The first transport path 32 is furnished with "sheet transporting mechanism" for moving the sheets to a desired direction (horizontal direction), and the second transport path 33 is furnished with "folding mechanism" for folding the sheets.

[Path Structure]

As shown in FIG. 3, in the device housing 29, the first transport path 32 is furnished between the carry-in port 30 and the carrying-out port 31. This path may be straight in the horizontal direction as illustrated, or may be structured with a curved path. This first transport path 32 guides the sheets to the carrying-out port 31, not folding the sheets.

The above mentioned second transport path 33 is structured as a folding path of folding the sheet from the carry-in port 30. As shown in FIG. 3, the second transport path 33 is divided from the first transport path 32, and both move the sheets from the carry-in port 30 to the carrying-out port 31.

These first transport path 32 and second transport path 33 are arranged in the crossing direction each other. A one part (later mentioned first switchback path 34) of the second transport path 33 is placed in an upper area of the first transport path 32, while a remaining one part (later mentioned second switchback path 35) is placed in a lower area of the first transport path 32.

In the second transport path 33, there is arranged a folding part 48 composed of folding rollers (41*b*, 49, 50), primarily-folding the sheets sent from the first transport path 32 at a first folding part Np1, and secondarily-folding them at a second folding part Np2.

In case the folding roll pair are composed with a pair of rolls (41*b*, 49), the sheets are once folded and sent to the carrying-out port 31, and in case the pair are composed with the plural rolls as shown, the sheets are once or twice folded and sent to the carrying-out port 31.

The second transport path 33 is composed of a first switchback path 34 of guiding the sheet endpoints for processing primarily-folding at the first folding part Np1 and a second switchback path 35 of guiding the primarily-folded sheets end points for processing secondarily-folding to the second folding Np2.

By the way, in case the second transport path 33 is composed for once folding, the path is composed omitting the second switchback path 35.

As having seen, the second transport path 33 is disposed in the direction crossing with the first transport path 32, and the first switchback path 34 in the upper area of the first transport path 32 is disposed in opposition to a path (shown is the second switchback path 35) transferring the sheet to the downstream from a crossing portion in the lower area.

The shown first switchback path 34 and second switchback path 35 are composed with curved paths respectively, and are formed in almost S-shape as shown in FIG. 3. In the second transport path 33, the first folding part Np1 and the second folding part Np2 are provided with a later mentioned folding mechanism and a first sheet discharging path 36 of carrying out the folded sheets to the carrying-out port 31.

The first transport path 32 and the second transport path 33 are disposed as crossing each other, and contrary to the path structure of FIG. 3, it is also enough to dispose the first switchback path 34 in the lower area of the first transport path 32 and to dispose a path in the upper area of the first transport path 32 for guiding the folded sheet to the downstream side.

The second transport path 33 communicates with a first sheet discharging path 36 for guiding the folded sheet to the carrying-out port 31. The shown first transport path 36 is provided between the second folding part Np2 of processing second-folding of the sheet and the carrying-out port 31. This first transport path 36 is provided with a second sheet discharging path 37 of guiding the folded sheet to an accommodating stacker (stacking part) 65 from a sheet discharging port 51 being different from the carrying-out port 31.

A path length (L1) of the first switchback path 34 for guiding the sheets from the first transport path 32 to the first folding part Np1 and a path length (L2) of the second switchback path 35 for guiding the first folded sheets to the second folding part Np2 are structured to be the path length L1>the path length L2.

A path length L3 of the second sheet discharging path 37 for guiding the folded sheets from the second folding part Np2 to the accommodating stacker (stacking part) 65 are structured to be L3<L2<L1.

This is because if positioning the first folding part Np1 nearly the first transport path 32, as a result, each of the path lengths is L3<L2<L1, so that the path structure is made compact.

Thus, the first switchback path 34 of the longest length is placed above the first transport path 32, and the second switchback path 35 of the short length is placed at the low part, and similarly, under the first transport path 32, the second sheet discharging path 37 is placed, and further-under, the accommodating stacker (stacking part) 65 is placed.

The first switchback path 34 having the long path is placed in the upper area of the first transport path 32, and in opposition thereto, the second switchback path 35 having the short path and the second sheet discharging path 37 are placed at the lower area, and further, under the second switchback path 35 and the second sheet discharging path 37, the accommodating stacker (stacking part) 65 is placed. By such a layout structure, the inside space of the device housing 29 is made intensive.

[Path Switching Means]

The crossing part of the first transport path 32 and the second transport path 33 is arranged with an under mentioned path switching means 63. As mentioned above, the second transport path 33 guides the sheet dividing from the first transport path 32 and sent from the carry-in port 30 to the first and second folding parts Np1, Np2. Therefore, at the crossing part of the first and second transport paths 32, 33, a path switching means is disposed.

The path switching means 63 is, as shown in FIG. 3, turnably pivoted on a shaft 62*x* of a carrying-out roller 62*a*, and guides the sheet sent to the first transport path 32 in the posture of a solid line in FIG. 3 to the first switchback path 34, and guides the sheets sent to the first transport path 32 in the posture of a broken line in FIG. 3 to the carrying-out port 31.

[Structure of Folding Rollers (Folding Processing Device)]

The second transport path 33 is arranged with a first roll 41*b*, a second roll 49 and a third roll 50 in a manner that they pressingly contact one another. At the contacting point between the first roll 41*b* and the second roll 49, the first folding part Np1 is provided for primarily folding sheets, and at the contacting point between the second roll 49 and the third roll 50, the second folding part Np2 is provided for secondarily folding sheets.

As to each of the first, second and third diameters, in the illustrated device, the diameter of the second roller is largest, and the diameters of the first and third rollers are equal. The sizes can be appropriately determined in a manner that, for example, the diameters of the first, second and third rolls are equal.

As shown in FIG. 3, the first roll 41*b* is disposed at a place that one part of its outer periphery faces the first transport path 32, and a pinch roller 41*a* presses the roller periphery.

Thereby, the sheet of the first transport path 32 is sent to the downstream side by the first roll 41*b* and the pinch roller 41*a*, and the first transport path 32 necessitates neither any especial sending means nor a driving mechanism thereof.

[Structure of Folding Deviating Member]

In the folding rollers as mentioned above composed of the three rolls (41*b*, 49, 50), the first folding part Np1 is arranged with a first folding deviating member 53, and the second folding part Np2 is arranged with a second folding deviating member 54. The first folding deviating member 53 and the second folding deviating member 54 are composed with mechanisms of inserting creased positions of the sheets sent to the second transport path 33 into the first folding part Np1 and the second folding part Np2.

With respect to the first folding deviating member 53 and the second folding deviating member 54, the shown device has functions of "inserting the folded position of the sheet into the roller nipping part (folding part)" and a function of "sending the sheet front end and rear end into the roller nipping part (folding part)".

Therefore the first and second folding deviating members 53, 54 have following rollers 53*a*, 54*a* and curving guides 53*b*, 54*b*, and are structured to move from a retreating position outside the path to an operating position inside the path.

By moving the following rollers 53*a*, 54*a* and the curving guides 53*b*, 54*b* from the retreating position to the operating position, the crease position of the sheet is inserted into the nipping part (folding part), and after then, the following rollers are pressed to the peripheries of the folding rollers to rotate, thereby to send the front and rear ends of the sheets into the nipping part (folding part).

[Structure of First Folding Deviating Member]

Figure 5:
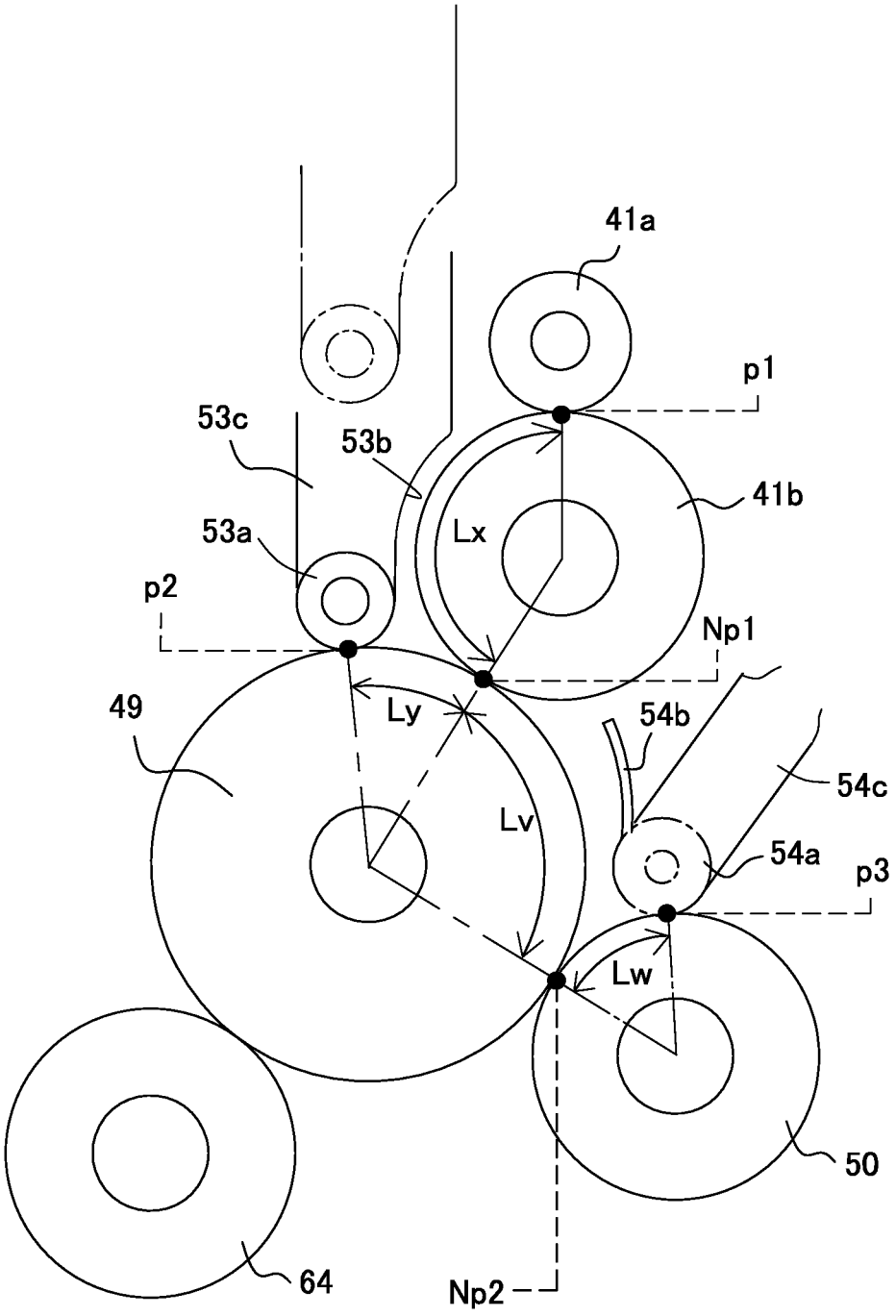
FIG. 5 An explanatory view of a lay-out structure of the folding rolls of the sheet folding device of FIG. 3.

The above first folding deviating member 53 is composed of the following roller 53*a*, the curving guide 53*b* and a hoist member 53*c* for guiding the sheet creases to the first folding part Np1, as shown in FIG. 5.

The following roller 53*a* and the curving guide 53*b* are supported by the hoist member 53*c*. This hoist member 53*c* is composed of a bracket member (frame member) of appropriate shapes, and the following rollers 53*a* is rotatably supported to this hoist member 53*c*, and the curving guide 53*b* is fixed thereto.

The hoist member 53*c* is supported by a guide rail (not shown) furnished to the device frame, and is structured to move vertically between the operating position (solid line in FIG. 5) where the following roller 53*a* contacts the periphery of the second roll 49 and the waiting position (broken line in FIG. 5) where the following roller 53*a* retreats outside of the path of the second transport path 33. To this hoist member 53*c*, a shift motor MS (not shown) is connected for moving the following roller 53*a* and the curving guide 53*b* between the operating position and the waiting position.

The following roller 53*a* contacts under pressure the second roll 49 positioned at the downstream side, and this contacting point is shown with "p2" in FIG. 5. When guiding the sheet crease position to the first folding part Np1, the rear side of the sheets is effected with transporting force at the contacting point p1, and the sheet crease position is guided to the first folding part Np1 following the periphery of the first roll 41*b*.

The front side of the sheets is effected with transporting force at the contacting point p2, and the sheet crease position is guided to the first folding part Np1 following the periphery of the second roll 49.

Then, the transporting length Lx between the contacting point p1 and the first folding part Np1 and the transporting length Ly between the contacting point p2 and the first folding part Np1 are set up to be Lx>Ly. To such length relationship the following roller 53*a* is positioned. The curving guide 53*b* forms a curving guide face following the periphery of the first roll 41*b* having a large transporting length.

In short, since the prior art has the blade members guiding the sheet creases to the folding parts (Np1, Np2) separately from a sheet drawing-out means, if a timing acting on the sheets is off, such an action causes positioning slides of the crease or wrinkles in the sheet.

For solving such occasions, the shown device sets up the transporting length Lx of the first roll 41*b* at the upstream side of the sheet toward the first folding part Np1 and the transporting length Ly of the second roll 49 at the downstream side as [Lx>Ly], and at the same time, the present device structures such a shape of making the curve of the curving guide 53*b* follow the sheets to the periphery of the first roll 41*b* having the long transporting length, and move the following roller 53*a* and the curving guide 53*b* from the waiting position to the operating position.

By making such a structure, not requesting any especial folding and blading means, the crease of the sheet can be exactly guided to the first folding part Np1. As apparently from FIG. 5, for setting the transporting length to be [Lx>Ly], the roller diameter of the following roller 53*a* must be shorter than the roller diameter of the first roll 41*b* positioned at the upstream side.

[Structure of Second Folding Deviating Member]

Similarly also in the second folding deviating member 54, transporting force is given to the sheet by the first folding part Np1 of the second roll 49 positioned at the upstream side, and the transporting length Lv from this point to the second folding part Np2 and the transportation length Lw between the second folding part Np2 and the pressure-contacting point p3 between the following roller 54*a* and a third roll 50 positioning at the downstream, is set up as [Lv>Lw].

The curving guide face of the guide member 54*b* is formed for the sheet to follow the periphery of the second roll 49 having the long transporting length. This second folding deviating member 54 and the previous first folding deviating member 53 move contrarily when one of them is at operation, the other is at waiting. This is because the hoist member 53*c* and the hoist member 54*c* are operated by the same driving means.

[Drive Mechanism]

The first transport path 32 and the second transport path 33 will be explained referring to FIG. 3. The first transport path 32 is disposed with a pair of carry-in rollers 40 at the carry-in port 30, and a pair of carrying-out rollers 62 at a carrying-out port 31. Between these both rollers, resist rollers are disposed. The shown resist rollers are structured with the outer periphery of a first roll 41*b* and a pinch roller 41*a* contacting the outer periphery.

Accordingly, the first transport path 32 is provided with the pair of carry-in rollers 40, the pair of carrying-out rollers 62 and the resist roller (first roller) 41*b*.

The pair of carry-in rollers 40 are composed of a pair of rollers 40*a*, 40*b*, and one 40*b* of them is connected with a transport motor (not shown). Similarly, the pair of carrying-out rollers 62 are composed of a pair of rollers 62*a*, 62*b*, and one 62*b* of them is connected with a transport motor Mf.

Further, the pinch roller 41*a* rotates and follows the first roll 41*b* and this first roll 41*b* is connected to the transport motor Mf.

The above mentioned second transport path 33 is disposed with a first roll 41*b*, a second roll 49 and a third roll 50 pressing one another, and a second sheet discharging path 37 is furnished with a pair of sheet discharging rollers 67. The second transport path 33 (first switchback path 34 and second switchback path 35) is not disposed with a sheet transport mechanism as shown in FIG. 3.

The second transport path 33 takes in the sheets into the first switchback path 34 by means of a pair of carry-in rollers 40 and the resist roller (first roller) 41*b* disposed in the first transport path 32, and the first and second rolls 41*b*, 49 transport the sheets to the downstream side.

The shown device simplifies the sheet transport mechanism disposed in the first and second transport paths 32, 33, miniaturizes and quiets the device, and lightens power consumption. Therefore, the first transport path 32 is arranged in a manner of facing one part of the outer periphery of the folding roller (first roll 41*b*) disposed in the second transport path 33 to the first transport path 32 between the pair of carry-in rollers 40 and of carrying-out rollers 62.

At the outer periphery of the first roll 41*b*, the pinch roller 41*a* is placed, and send the sheet from the pair of carry-in rollers to the first switchback path 34. Thereby, it is unnecessary to arrange any special transport roller in the first transport path 32, so that the transport mechanism is simplified.

Together with it, when folding the sheets, the above mentioned execution rotates the first roll 41*b*, and at a mode of transporting the sheets from the pair of carry-in rollers 40 to the first switchback path 34 by means of the pair of carry-in rollers 40 and the first roll 41*b* as well as a mode of transporting the sheets from the carry-in port 30 to the carrying-out port 31, not folding the sheets, the execution stops the first roll 41*b* and moves the sheets from the carry-in port 30 to the carrying-out port 31 by means of the pair of carry-in rollers 40 and the carrying-out rollers 62. Thereby, the execution accomplishes lightening of power consumption and quieting of driving the device.

Further, the hoist member 53*c* of the first folding deviating member 53 and the hoist member 54*c* of the second folding deviating member 54 are connected with a shift motor MS (not shown) in order to move the positions between the waiting position and the operating position. The shift motor MS is composed of a reciprocal motor, and pinions 53*p*, 54*p* are in mesh with racks 53*r*, 54*r* formed in a first hoist member 53*c* and a second hoist member 54*c*.

When normally rotating the shift motor MS, the first hoist member 53*c* moves from the waiting position to the operating position, and when reversely rotating, the second hoist member 54*c* moves from the waiting position to the operating position.

[Structure of Sheet Stacking Part]

At first, in FIG. 3, the accommodating stacker (stacking part) 65 is placed under the second sheet discharging path 37, and the sheet stacking part is structured with this accommodating stacker (stacking part) 65. The accommodating stacker (stacking part) 65 places the sheet folded between the second roll 49 and the third roll 50.

Therefore, the accommodating stacker (stacking part) 65 is arranged vertically in the order of the first transport path 32 in the device housing 29, a folding part 48 thereunder, and the accommodating stacker 65.

As mentioned above, the first transport path 32 and the second transport path 33 are disposed as crossing with each other, and the first switchback path 34 of the second transport path 33 is disposed in the upper area of the first transport path 32, while the second switchback path 35 is disposed in the under area of the first transport path 32.

At the same time as making this path structure, since the folding part 48 is placed under the first transport path 32 and the accommodating stacker (stacking part) 65 is placed thereunder, the present device can be made compact.

As shown in FIGS. 6 to 9, the accommodating stacker (stacking part) 65 is composed of the stacking face 84 of holding the folded sheet from the pair of rollers 67 and the accommodating area As formed with outer walls 83*a*, 83*b*, 83*c* and an open-close door 85.

This accommodating stacker (stacking part) 65 has an accommodating area As having a height (stacking amount) H in cross sectional shape (rectangular) of a long side Sn and a short side Sp of the folded sheet (see FIG. 3). The folded sheet is dropped from the sheet discharging port 51 and accommodated into the accommodating area As of the bottom size having the length (folding width) Sp in the short direction, the length (sheet width) Sn in the long direction and the height H. By the way, the height H is decided from a stacking amount of the folded sheets when designing the device.

At this time, if a head (difference between the discharge port and sheet face) is large, there rise a problem of the stacked sheets entering into folded space of the accommodated sheets, a problem of the sheets piled in disorder, and a further problem of the sheets bent at lower edges owing postures dropping.

According to FIG. 8, explanation will be made to a manner of accommodating the folded sheet into the stacker from the second sheet discharging path 37. As mentioned above, the sheet to be accommodated into the stacker 65 is folded in rectangular shape (called as "rectangular strip" hereafter) having a short side and a long side of ⅓ (or ¼), and the sheet is discharged from the discharge port 51 in postures of the long side Sn placing back and forth in the sheet discharging direction.

Figure 8:
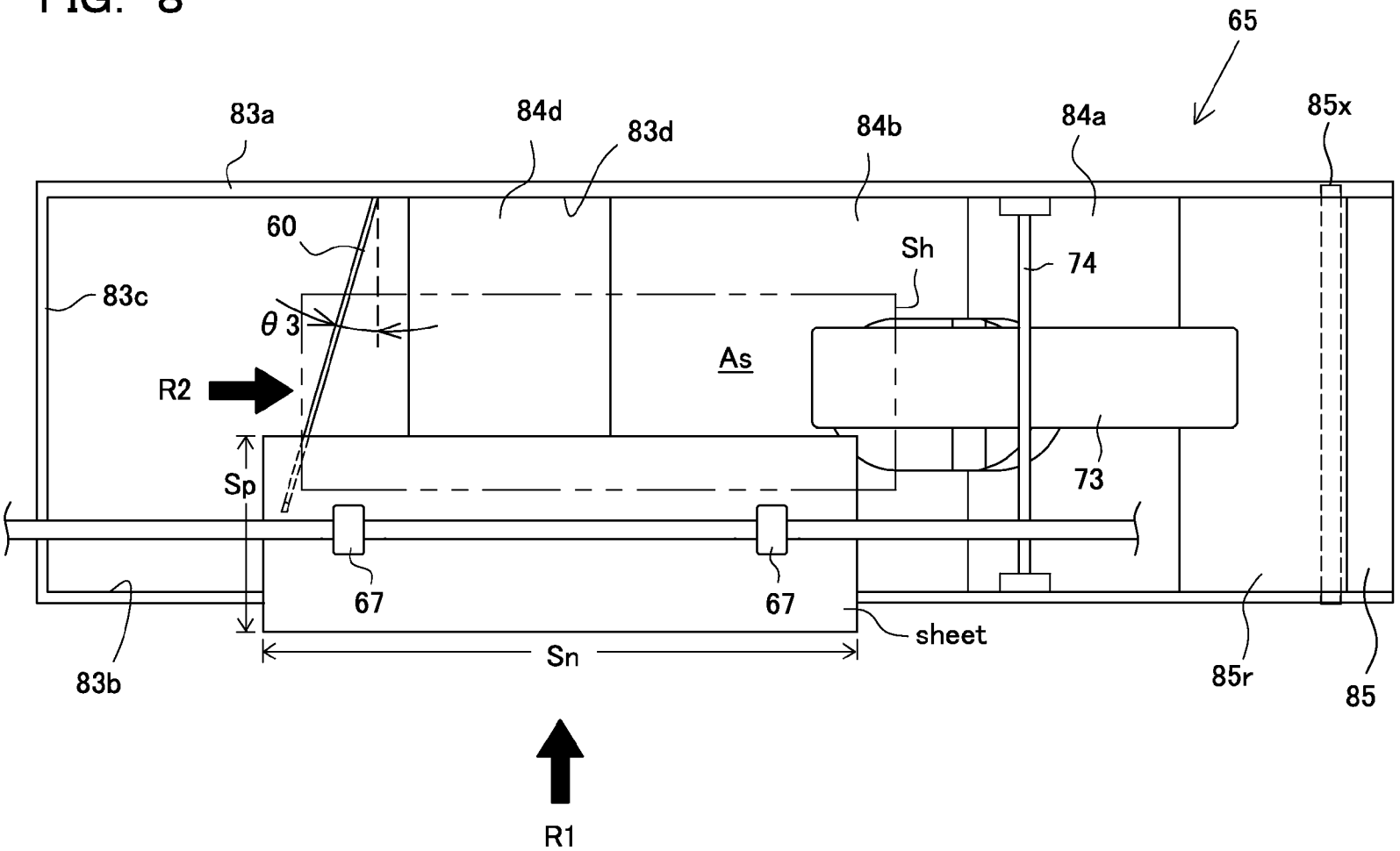
FIG. 8 A view seeing the sheet stacking part in the sheet folding device from the top part of FIG. 3.

As showing the first sheet discharging direction R1 in FIG. 8, for the folded sheet discharged with the head of the long side Sn, the accommodating area is formed in the second sheet discharging direction R2 crossing with the sheet discharging direction. Therefore, the stacking face 84 and outside walls 83*a* to 83*c* are placed in away that the length side is positioned in a crossing direction with the discharged sheet.

Figure 9:
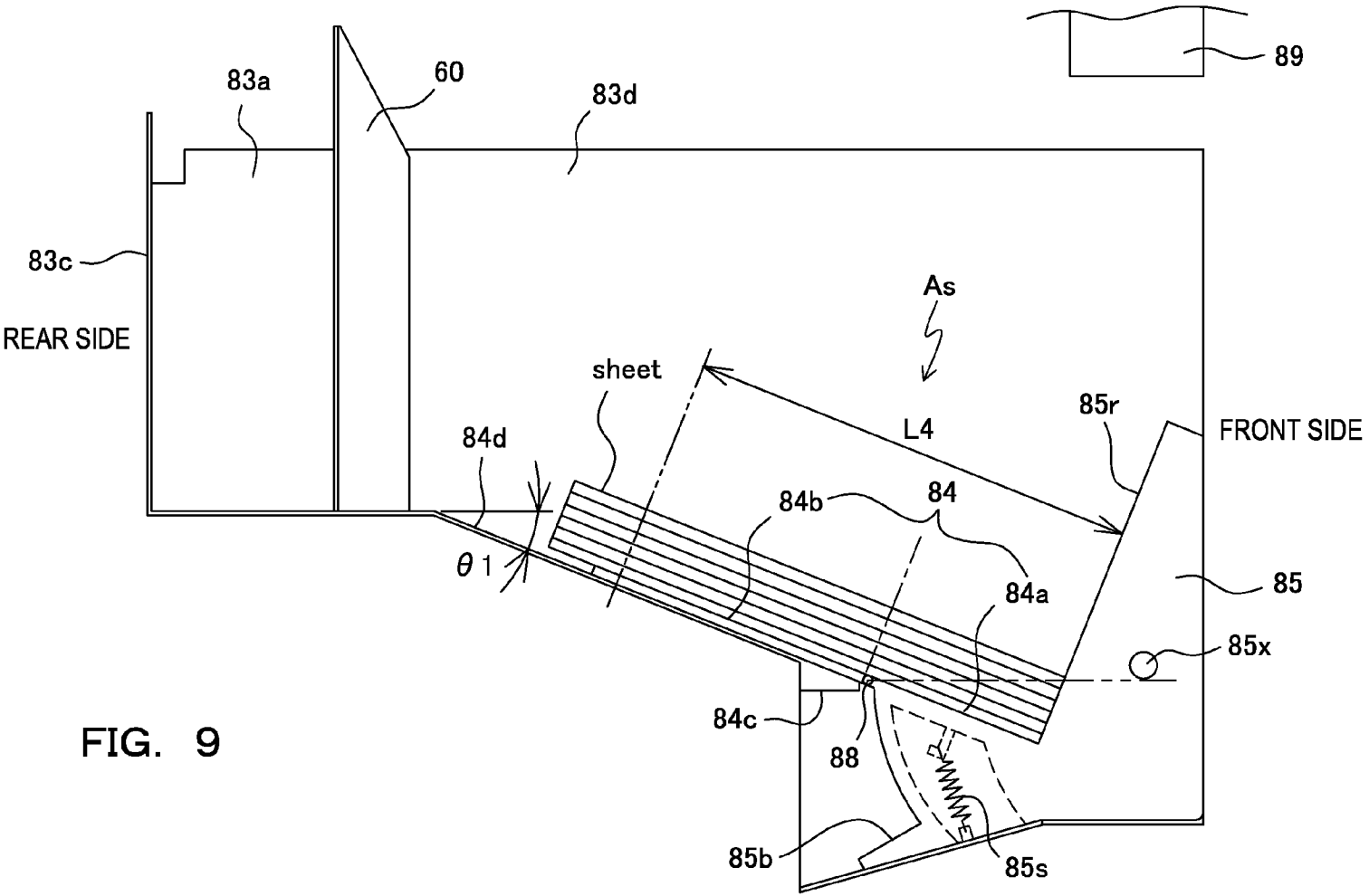
FIG. 9 An explanatory view seeing the sheet stacking part from its side part, showing the sheets on the stacking face.

As showing in FIG. 9, assuming that aside being furnished with the open-close door 85 is a device front side and the other side is a device rear side, the stacking face 84 is inclined at an angle θ1 such that the device front side is lower than the device rear side. The sheets stacked on the stacking face 84 move to the device front side along the inclination, and a later mentioned registration part 85*r* regulates the front ends of the folded sheets. By the way, desirably, this inclination angle θ1 is set 15 to 40 degree.

Figure 6:
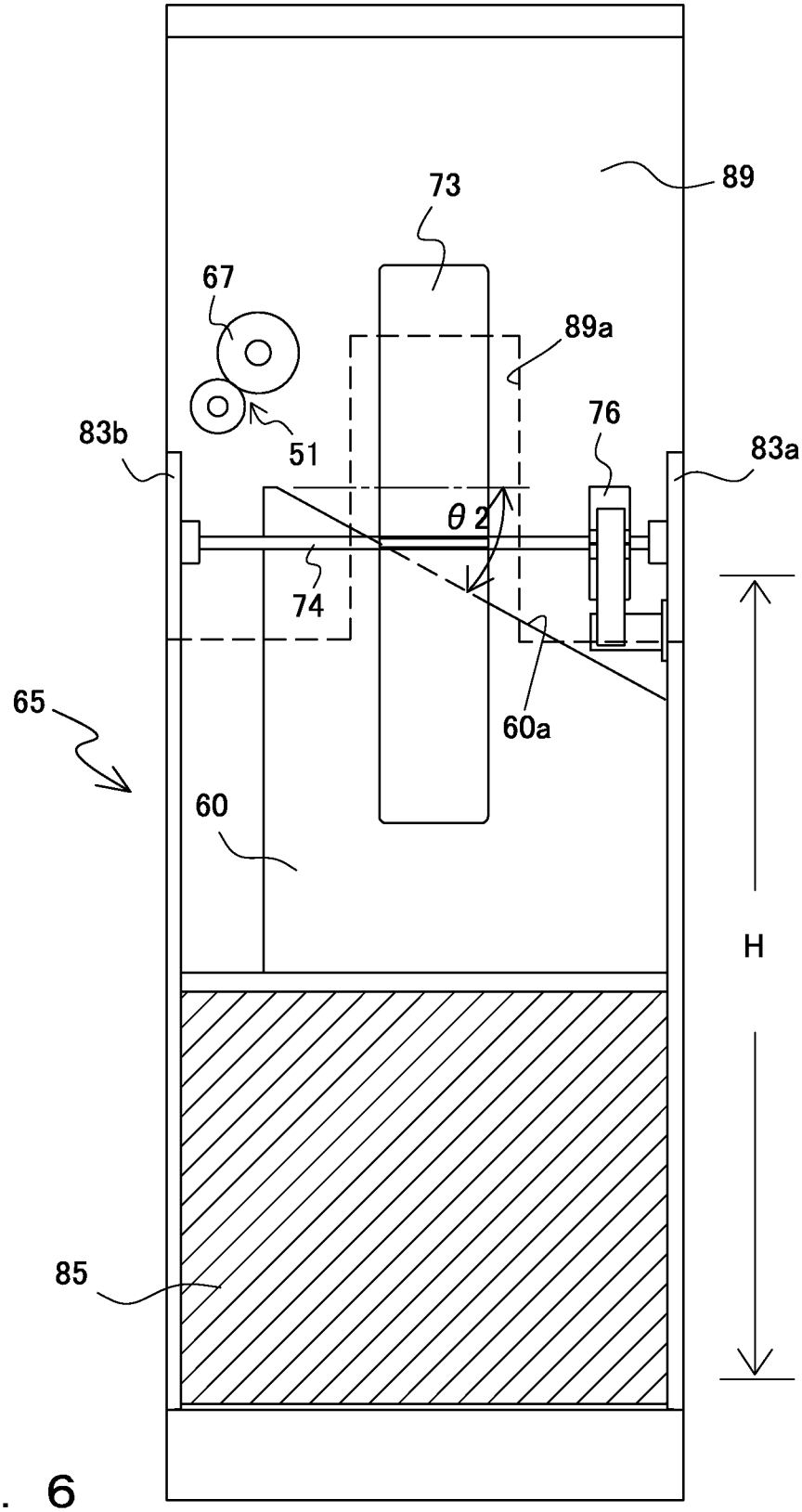
FIG. 6 A view seeing the sheet stacking part in the sheet folding device from the front part of FIG. 3.
Figure 7:
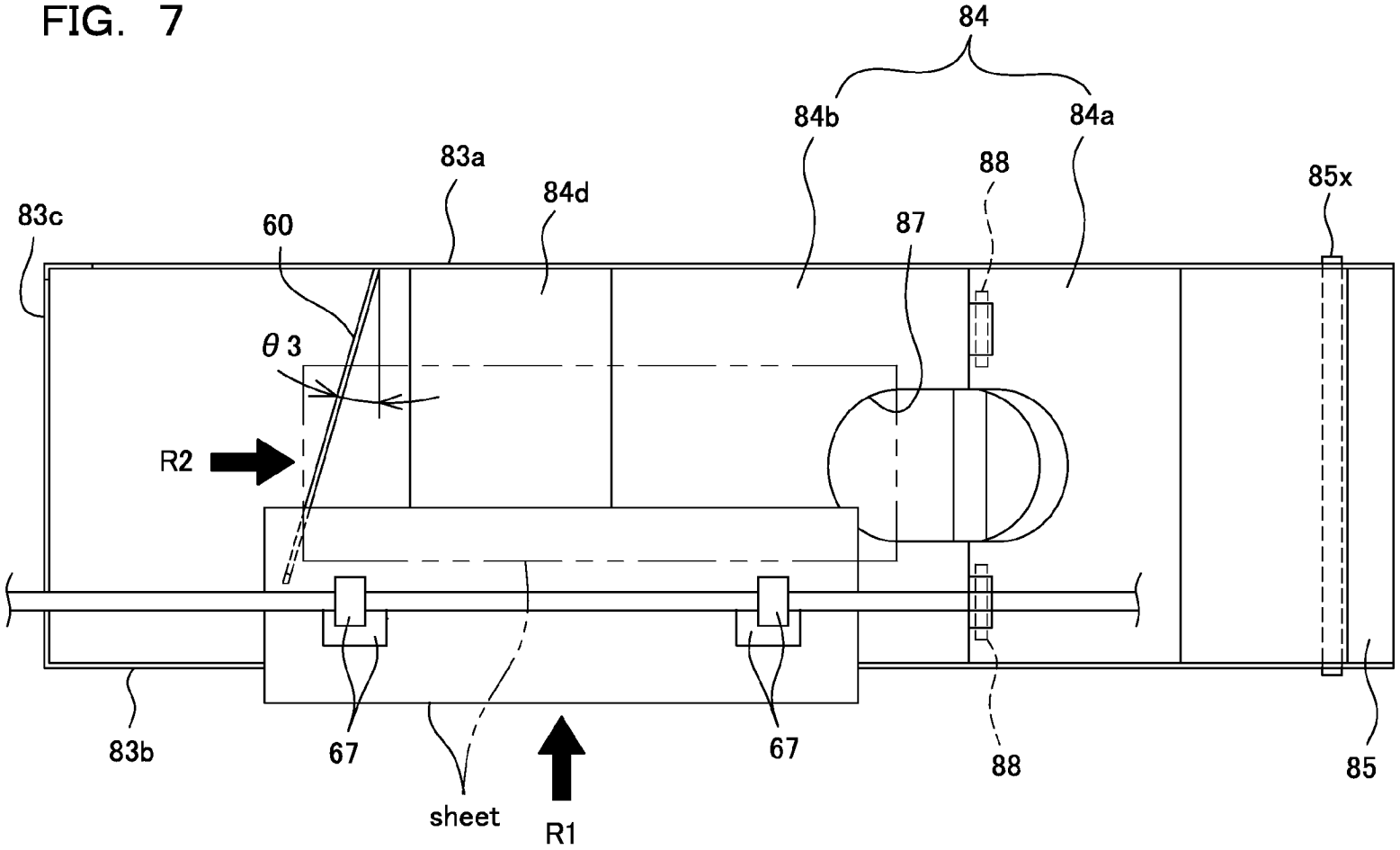
FIG. 7 A view seeing the sheet stacking part in the sheet folding device from the top part of FIG. 3.

The device rear side of the stacking face 84 is, as shown in FIGS. 6 and 7, arranged with a guide wall 60 for guiding the folded sheet discharged from a pair of sheet discharging rollers 67 to the stacking face 84. The guide wall 60 is composed of a plate shape member elongating from the pair of sheet discharging rollers 67 to an outside wall 83*a*.

The guide wall 60 is placed at the device rear side of a pair of sheet discharging rollers 67 (see FIG. 7). Thereby, the guide wall 60 supports the device rear side of the folded sheet discharged in the first sheet discharging direction R1 crossing with the crease from the pair of sheet discharging rollers 67.

Figure 13:
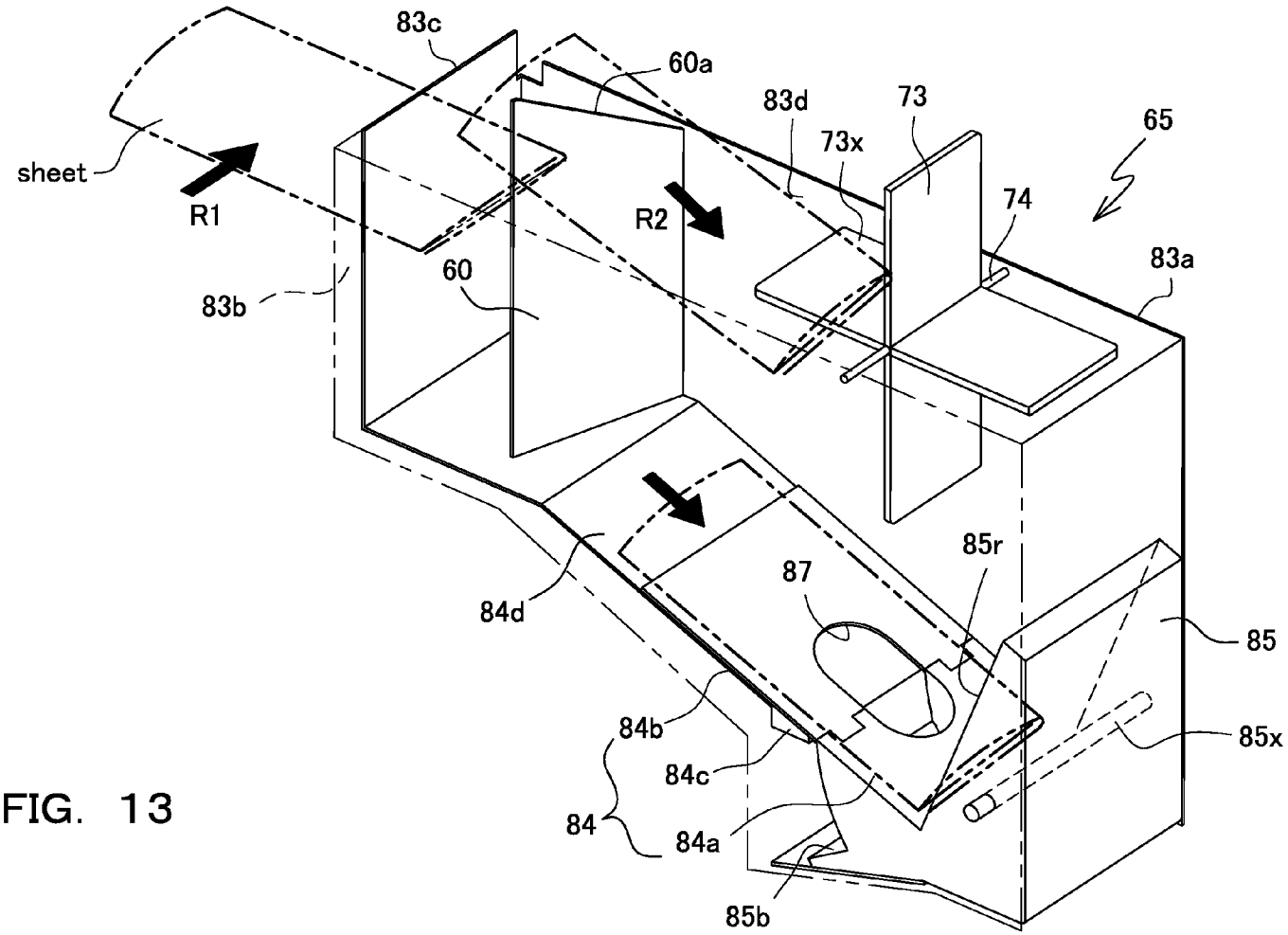
FIG. 13 An outlined explanatory view of discharging the sheets in the accommodating part of the folded sheets in the device of FIG. 3.

Then, as shown in FIG. 13, the folded sheet inclines by its own weight toward the device front side, and change the direction toward a second sheet discharging direction R2 meeting the crease, and are stacked on the stacking face 84.

By changing the first sheet discharging direction R1 to the second sheet discharging direction R2 almost crossing with the direction R1, the sheet exactly slips down on the stacking face 84, and is regulated at its front end by a later mentioned registration part 85*r*, and the stacking face 84 can stack the folded sheet in good registration.

Further, since the folded sheets are stacked to the device front side facing the user, the user's recognition can be made good so that forgetting of bringing the stacked sheets can be avoided.

The guide wall 60 is inclined at the angle θ2 in such a manner that, with respect to the horizontal face, the downstream side of the first sheet discharging direction R1 is made lower than the upstream side (see FIG. 6).

Thereby, the sheet discharged from the pair of sheet discharging rollers 67 is smoothly discharged along the guide face 60*a* of the guide wall 60, and the sheet can be avoided from dropping vertically from the downstream end of the first sheet discharging direction R1. By the way, desirably, this inclination angle θ2 is set 15 to 50 degrees.

The guide wall 60 is, as shown in FIG. 6, disposed in the position where the sheet engaging portion of a guide face 60*a* is biased to one side with respect to the length (length of the long side) of the discharging sheet in an orthogonal direction of the folded sheet. This is because the sheet dropping posture is regulated such that the folded sheet placed on the guide face 60*a* drops firstly with its one front end side, and the sheet drops firstly with its right end of inclining gravity from the guide face 60*a*.

Further, as shown in FIG. 7, the guide wall 60 is placed at inclination angle θ3 with respect to the first sheet discharging direction R1 on the stacking face 84. Thereby, as shown in FIG. 13, the supporting position of the guide wall 60 at the upstream end of the first sheet discharging direction R1 of the sheet, is toward the device rear side in comparison with the supporting position of the guide wall at the down stream end of the first sheet discharging direction R1. Therefore, the sheet upstream end precedes the downstream end and forms an inclining condition to the device front side, and slips down in the second sheet discharging direction R2 and stacks on the stacking face 84. By the way, desirably, this inclination angle θ3 is set 15 to 45 degrees.

At the case of the inclination angle being "θ3=0", before the sheet having gotten out the sheet discharging port 51 collides with the regulating face 83*d*, the sheet has a danger of dropping on the stacking face, and if setting up this inclination angle "θ3" to be a large angle, the sheet on the guide face 60*a* does not fairly drop. Therefore, the sheet might rebound after colliding at the front end with the regulation face 83*d*.

The inclination angle θ3 has the following means. Firstly, the sheet is guided from the sheet discharging port 51 along the guide face 60*a* to the regulating face 83*d*. Secondly, the folded sheet got out from the sheet discharging port 51 is guided by the guide wall 60 and collides with the regulation face 83*d*, and after then, drops onto the stacking face 84.

When the angle θ3 is "zero" (right angle with the regulating face), unstably, the length side of the folded sheet drops firstly or the other drops firstly. If the sheet dropping posture is unstable, the sheet enters into the folded inside from the opening part of the folded sheet stacked on the stacking face.

For avoiding inconvenience in the lined row, the shown device regulates the dropping posture of the folded sheet such that one side of the folded sheet drops firstly by disposing the guide wall 60 (the shown one side is the rear end side in the sheet discharging direction, but the front end side may drops firstly). Therefore, the angle of the shown inclination angle θ3 is regulated such that the long side of the rear end side in the sheet discharging direction drops firstly.

By disposing the guide wall 60 in such a manner, it is possible to solve a problem that the downstream end of the sheet discharged from the first sheet discharging direction R1 enters into the already stacked folded part and causes a sheet jam, and to stack the sheets in good registration.

This guide wall 60 may be structured to move to the device rear side from the device front side in response to the sizes of the sheets to be stacked by a not shown driving means.

As shown in FIG. 9, the stacking face 84 is composed of a first supporting face 84*a* of supporting the front part of the sheets to be stacked in the second sheet discharging direction R2 and a second supporting face 84*b* of supporting the rear part of the sheets to be stacked in the second sheet discharging direction R2. The first supporting face 84*a* and the second supporting face 84*b* are connected by a connecting member 88 as shown in FIG. 7.

The first supporting face 84*a* is set to be shorter than ½ of a sheet minimum size length L4, and at the device front side of this first supporting face 84*a*, a registration part 85*r* is disposed for regulating and arranging properly the front ends of the sheets.

The registration part 85*r* is formed integrally with an open-close door 85 for taking out the sheets stacked at the side in the device front side. In the invention, as shown in FIG. 9, the open-close door 85 has integrally the registration part 85*r* and the first supporting face 84*a*, and for example, sufficiently, the registration part door 85 is provided to the device front side.

Figure 14:
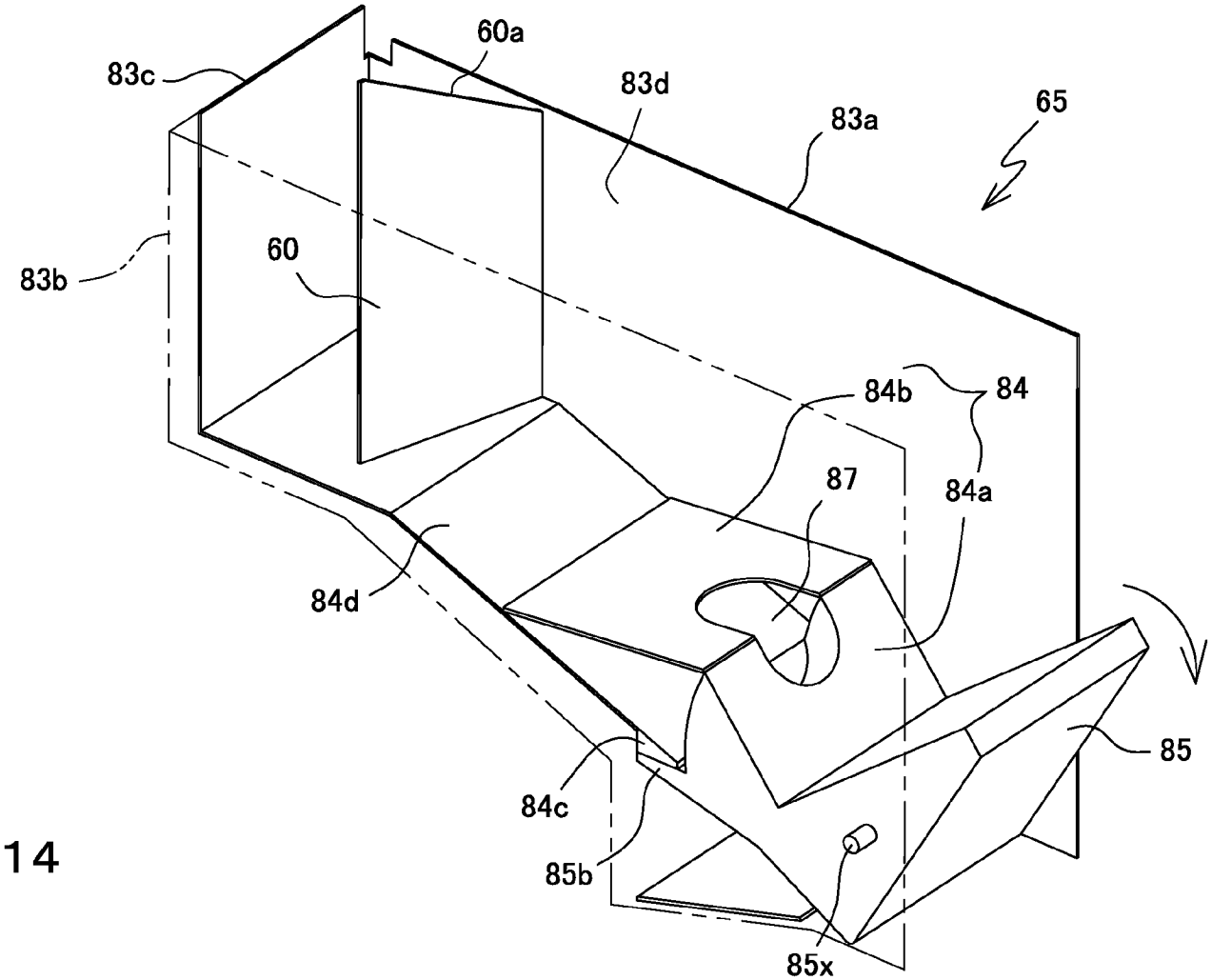
FIG. 14 A perspective view of the sheet stacking part, showing that a door is opened.

As seeing FIGS. 13 and 14, the open-close door 85 is rotatably supported by a rotating shaft 85*x* to outer walls 83*a*, 83*b*. This rotation regulates the open-close door 85 not to open more than unnecessarily by a contacting portion 85*b* contacting to a regulating portion 84*c*.

Figure 12:
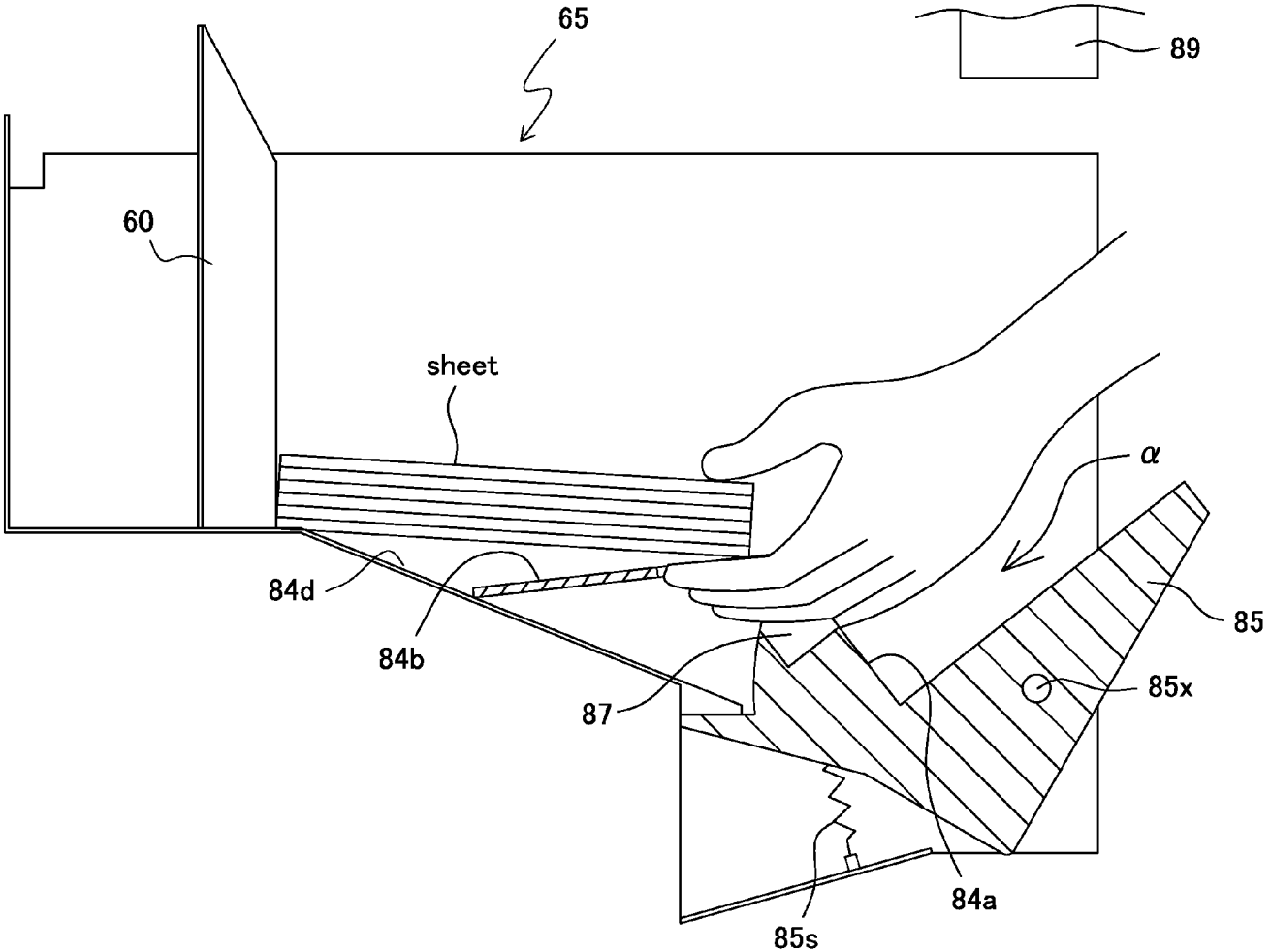
FIG. 12 An explanatory view seeing the sheet stacking part from its side part, showing that the stacked sheets are taken out by a hand inserting in a cut-out.

When the user takes out the sheets stacked on the stacking face 84, the open-close door 85 is rotated to a device front side (clockwise in the figure) to open the accommodating stacker 65, and the user directly inserts the hand to take out the sheets (see FIG. 12).

Figure 11:
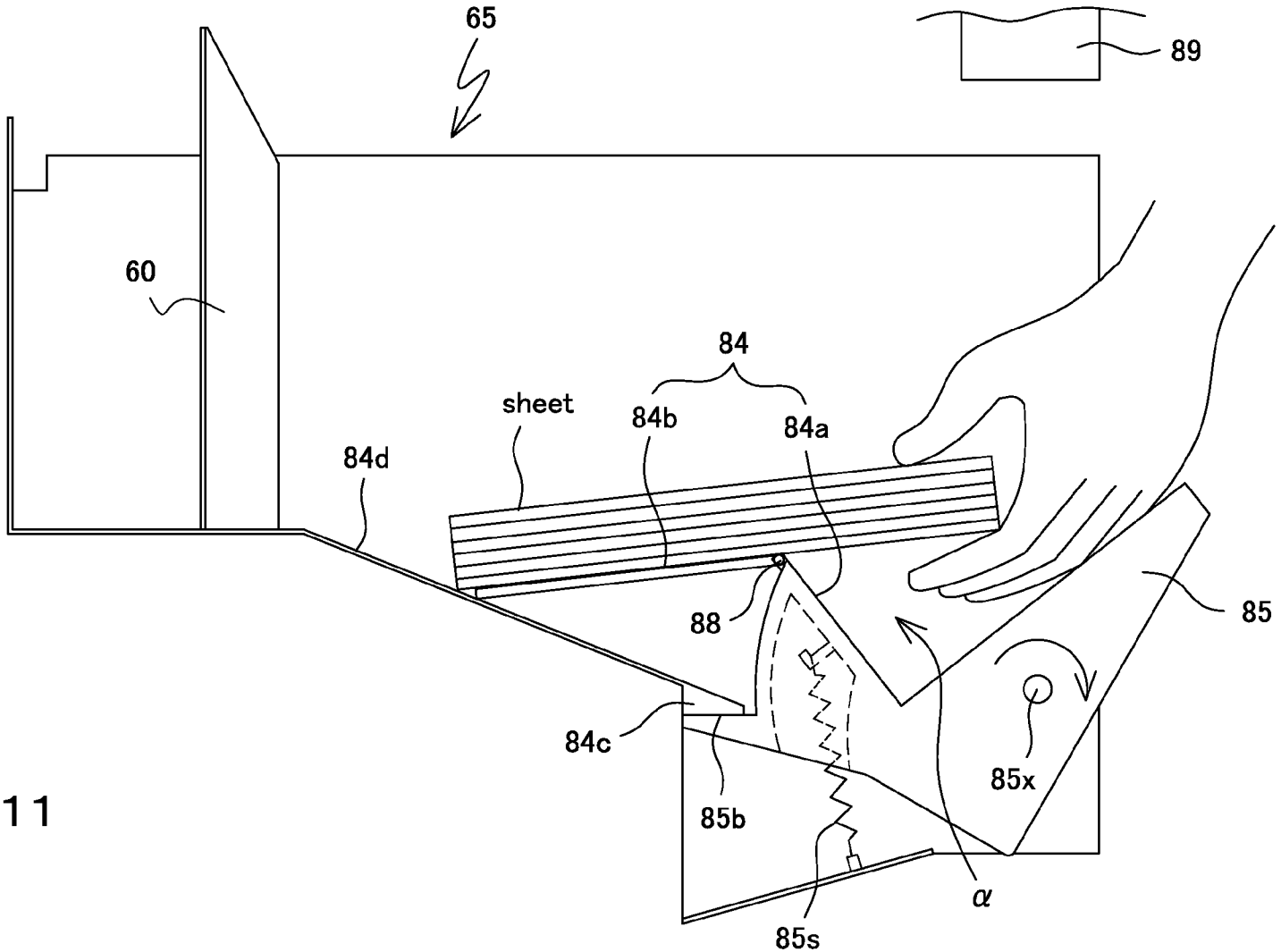
FIG. 11 An explanatory view seeing the sheet stacking part from its side part, showing that the stacked sheets are taken out.

Then, as shown in FIG. 11, since the first supporting face 84*a* rotates upward by rotating the open-close door 85, the sheet front ends on the first supporting face 84*a* are lifted upward around a fulcrum of the connection portion of the second supporting 84*b*.

Thereby, between the front ends of the folded sheet bundle and the first supporting face 84*a*, a space a is formed, so that the space can be secured for the user inserting the hand to take out smoothly the sheets.

The stacked sheets go up from the first supporting face 84*a* in company with rotation of the open-close door 85, and in regard to an operation of releasing the open-close door 85 and an operation of rotating upward the first supporting face 84*a*, one operation of releasing action enables to take out the sheets, so that operating performance is improved.

Further, as shown in FIG. 9, the rotation shaft 85*x* of the open-close door 85 is provided above an imaginary line extending in a horizontal direction from a connecting member 88. Thereby, when the first supporting face 84*a* rotates upward, since a rotating locus of the connecting member 88 is almost perpendicular, the sheet on the first supporting face 84*a* can be lifted up, not breaking the stacked posture.

Since the first supporting face 84*a* is set to be shorter than ½ of length L4 in minimum size, the sheet front ends of many kinds can be exactly lifted upward.

In FIG. 9, the downstream end in the second sheet discharging direction R2 of the second supporting face 84*b* is connected as mentioned above. On the other hand, the upstream end in the second sheet discharging direction R2 is only supported on an inclination face 84*d*, and so it can be moved freely.

Therefore, in accompanying upward rotation of the first supporting face 84*a* around the rotating shaft 85*x*, the downstream end in the second sheet discharging direction R2 of the second supporting face 84*b* moves upward, while the upstream end moves in the downstream of the second sheet discharging direction R2 (see FIG. 11).

Then, since the second supporting face 84*b* is almost horizontal or the device front side is higher than the device rear side, the sheet rear end to be stacked is almost horizontal or the device front side is upward, the folded sheet lifted by rotation of the first supporting face 84*a* can certainly support the upward lifted condition, not sliding toward the device rear side.

Figure 10A:
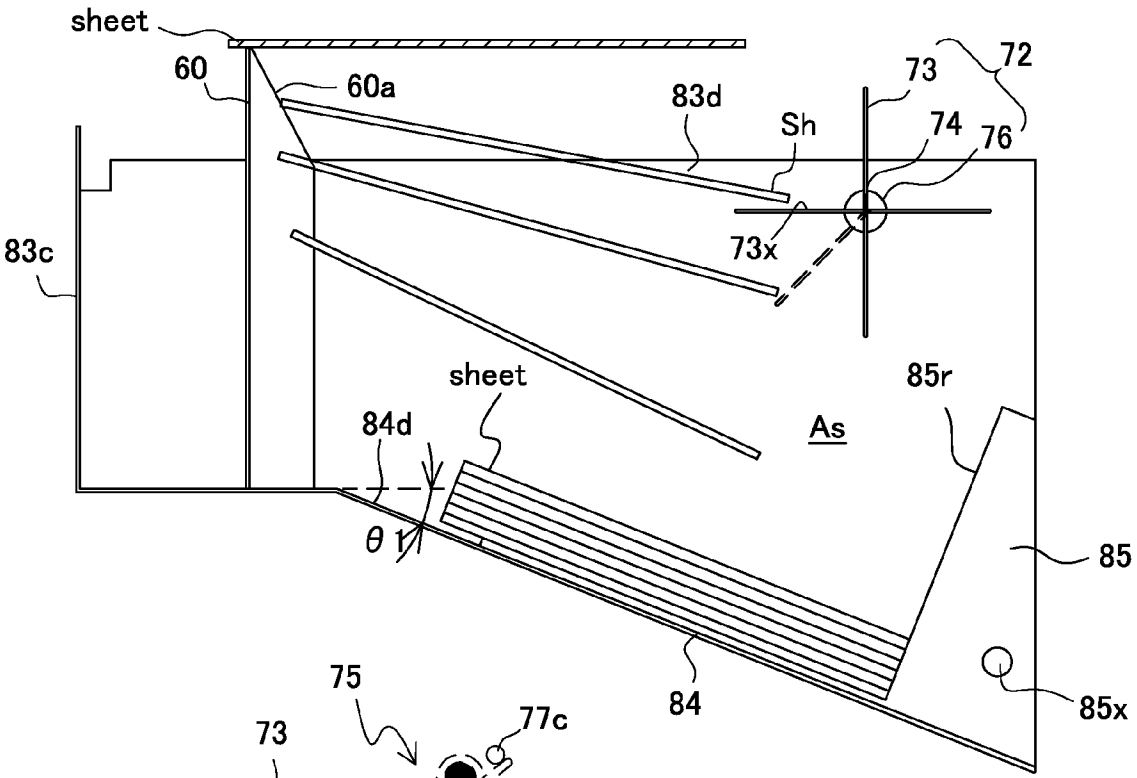
FIG. 10 An explanatory view of a side structure (device side) of the accommodating part of the folded sheets in the device of FIG. 3.
Figure 10B:
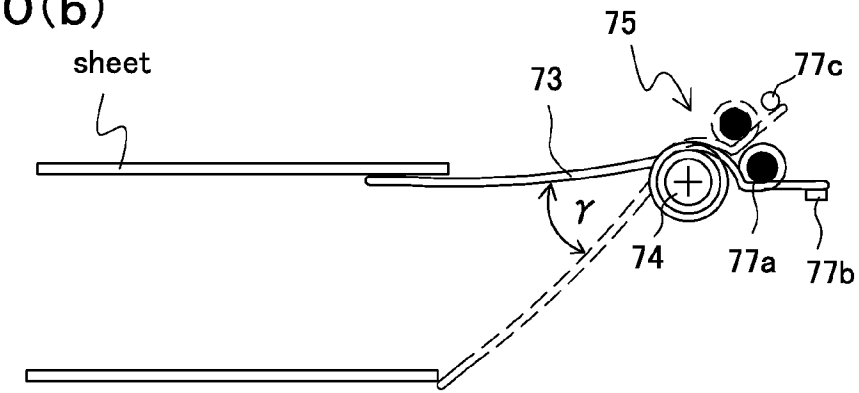

By the way, in the present embodiment, the first supporting face 84*a* and the second supporting face 84*b* are connected, and in company with rotation of the first supporting face 84*a*, the second supporting face 84*b* is possible to move, and it is also possible that only the first supporting face 84*a* is rotated to lift upward the stacked sheets, securing the second supporting face 84*b* on the inclination face 84*d* (see FIG. 10).

In the meantime, at the connecting point of the first supporting face 84*a* and the second supporting face 84*b*, as shown in FIG. 7, a cutout 87 is provided. This is because, when the user inserts the hand in the space a, even if squeezing by error the stacked sheets into the device rear side, and stacking the folded sheets perfectly on the second supporting face 84*b*, the user inserts the fingers into the notch 87 and can take them out as shown in FIG. 12.

The open-close door 85 of this invention has a biasing spring 85*s* for energizing the open-close door to the closing position, and when the user releases the hand from the open-close door 85, it automatically returns to the closing position. Sufficiently, not only the biasing spring 85*s* but also a lock mechanism such as a plate spring (not shown) are provided so that the open-close door 85 is held at an open position.

[Structure of Braking Mechanism]

This invention disposes a braking mechanism 72 within the accommodating area As for dropping the folded sheets onto the stacked face (on the stacked sheets) at moderate speed. The braking mechanism 72 touches the dropping sheets at the front ends (FIG. 10; Sh) to brake the dropping speed by a braking shoe.

Therefore, the shown mechanism is composed of a blade member 73, a shaft member 74 and a braking means 75, this blade member 73 having an engaging face 73*x* touching the sheets at the front ends Sh dropping from the sheet discharging port 51 toward the stacking face 84 within the accommodating area, the shaft member 74 supporting the blade member 73 rotatably in the sheet dropping direction, and the braking means 75 reducing (braking) rotating speed of the blade member 73.

The braking mechanism is explained referring to FIG. 10. Within the accommodating area As, the blade member 73 is arranged, touching the folded sheet at the ends (right end in FIG. 10) entering from the sheet discharging port 51 into the area.

The blade member 73 is composed of one sheet or plural sheets of blades rotatably in the dropping direction (counter clockwise in FIG. 10) and is disposed at the blade end within the moving locus of the sheets dropping from the sheet discharging port 51 into the stacking face 84.

Accordingly, the sheets dropping from the sheet discharging port 51 drop at the blade front ends downward together with rotation of the blade.

The shown blade member 73 has the four sheets of blades 73*a*, 73*b*, 73*c*, 73*d*, and are supported rotatably in the sheet dropping direction. The shaft member 74 is composed of bearing members provided to the outer wall parts 83*a*, 83*b*.

The thus composed blade member 73 has the braking member 75 reducing rotation speed (rotation speed in the sheet dropping direction). Rotation speed of the blade member 73 touching the dropping sheets at the ends controls the sheet dropping speed. For this purpose, the blade member 73 has the braking means 75 for reducing rotating speed.

FIGS. 6 and 10(*a*) show embodiments of furnishing the brake mechanism 76 on the rotating portion (shaft supporting member 74), and FIG. 10(*b*) shows an embodiment of furnishing a balance weight 77*a* on the rotating portion (shaft supporting member 74).

Figure 15A:
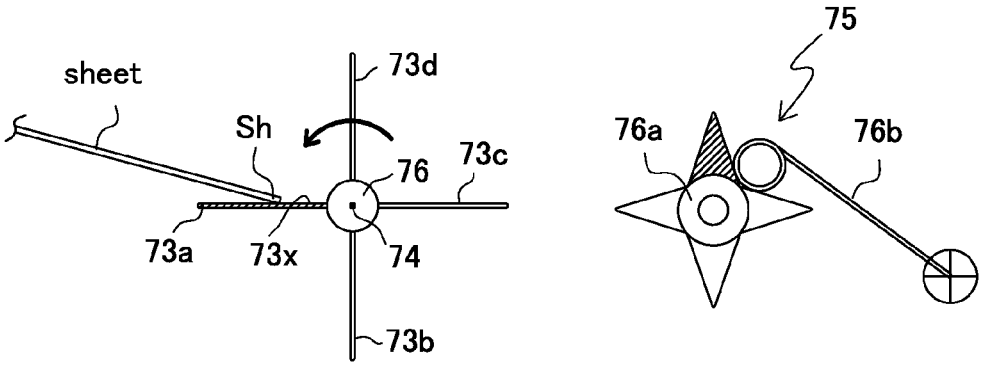
FIG. 15 Explanatory views of carrying out the sheet into the accommodating part of the folded sheet in the device in FIG. 3.
Figure 15B:
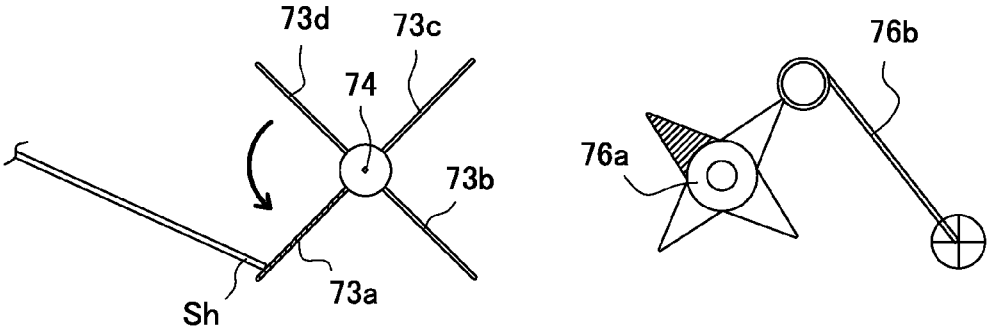
Figure 15C:
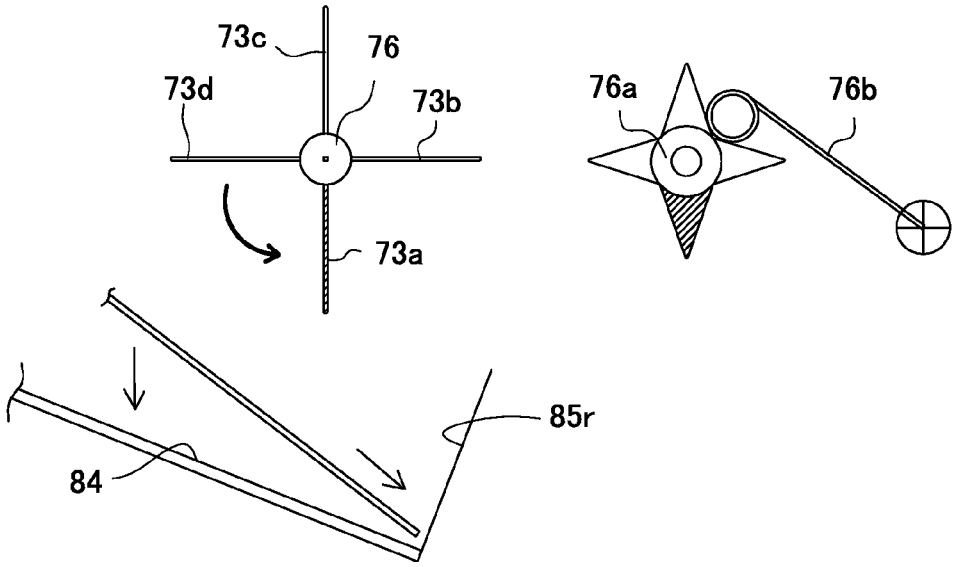

The brake means 75 shown in FIG. 15(*a*) furnishes an angle control cam member 76*a* on the rotation supporting shaft 74 of the blade member 73. The cam member 76*a* is pressure-contacted with each of blade members 73 by a plate spring (biasing spring) 76*b* pivoted to the outer wall part 83*a*.

In the blade members 73*a* to 73*d* of four sheets, the cam member 76*a* is formed in a shape (e.g., ball shape) engaged between the adjacent blades, acting in a direction of the plate spring 76*b* pressure-contacting.

Operation will be mentioned later, and when the blade member 73 is at an initial position of FIG. 15(*a*), the blades are acted to stop there, and when the blades rotate counter-clockwise owing to own weight of the sheets dropping, the speed is acted to reduce rotation.

From the condition of FIG. 15(*b*) where the sheets separate from the blades and drop owing to own weight, the cam member 76*a* rotates the blade member 73 by action of the plate spring 76*b*, and the condition recovers to the initial condition of FIG. 15(*c*) and preparation is made for subsequently dropping sheets.

The brake means 75 shown in FIG. 10(*b*) has the balance weight 77*a* on the shaft supporting member 74 of the blade member 73. The shown blade member 73 is composed of one sheet blade, and is supported to the outer wall part 83 rotatable around the shaft supporting member 74.

Between a first stopper 77*b* and a second stopper 77*c* provided to the outer wall part (or the device frame), turning is possible at angle γ.

The blade member 73 is provided integrally with a balance weight 77*a* for holding the blade member 73 to engage with the front end of the sheet at an initial step of dropping. This balance weight 77*a* is structured with a weight being lighter in weight than that of the dropping sheet at such a difference in the weight (sheet weight−the weight>0) reducing speed of the sheet dropping from the sheet discharging port 66.

In the above mentioned accommodating area As, the blade member 73 is provided within the moving locus where the sheet drops, and the sheet is caught at front ends Sh by the engaging face 73*x*. Then, the blade member 73 is rotatable in the sheet dropping direction and worked by the braking means 75. The braking means 75 is composed of the braking mechanism of reducing the sheet dropping speed and the balance weight.

Accordingly, the sheets dropping from the sheet discharging port 51 are reduced in dropping speed by the blade members 73 and lightly dropped onto the stacking face 84.

Thus, the blade member 73 moderately guides the folded sheets onto the stacking face, and at the same time, prevents the sheets at the ends from being caught by other structuring members. The blade member 73 guides the ends of the folded sheets onto the stacking face, and after then, as shown in FIG. 15(*c*), returns to the initial condition shown of FIG. 15(*a*) after the sheet ends separate from the engaging face 73*x*. This return is effected by force of a biasing spring of a weight.

The upper part of the device of the above mentioned accommodating stacker (stacking part) 65 is covered with a sheath cover 89 as shown in FIG. 6. This is because when the user takes out the sheets from the accommodating stacker 65, the hand does not enter into the structure part of the upper part of the device by error.

The sheath cover 89 is provided with a cutout part 89*a*, and when the user confirms the sheets stacked on the stacking face 84, this cutout part 89*a* confirms the printing parts of the stacked sheets having not been confirmed by the sheath cover 89, and the sheet stacking part more excellent confirming property can be structured.

[Detecting Sensor of Sheet Front Ends]

The above mentioned first transport path 32 is, as shown in FIG. 3, furnished with a first sensor S1 for detecting ends (front and rear ends) of the sheets entering into the first switchback path 34. Further, a second sensor S2 is furnished for detecting the ends of the sheets entering into a second switchback path 35. For calculating the crease positions of the sheets, the first and second sensors S1, S2 detect the ends of the sheets, and functions thereof will be mentioned together with a later mentioned folding specification.

[Folding Specification]

Figure 21A:
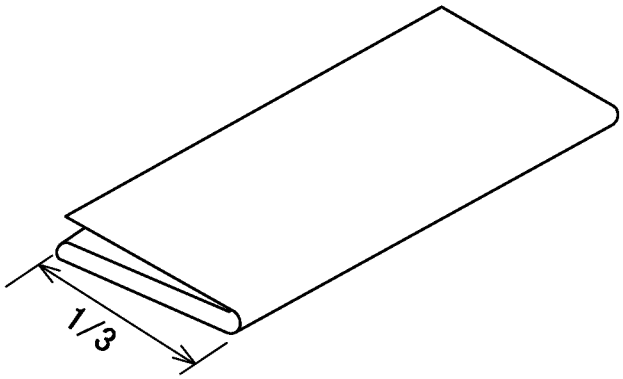
FIG. 21 Explanatory views of the sheet folding specifications, (a) showing the sheet effected with an inner three-fold at a ⅓ position, (b) showing the sheet effected with a Z-fold at the ⅓ position, and (c) showing the sheet effected with the Z-fold at the ¼ position.
Figure 21B:
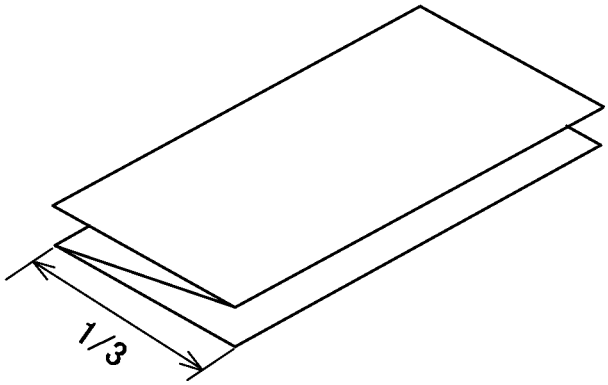
Figure 21C:
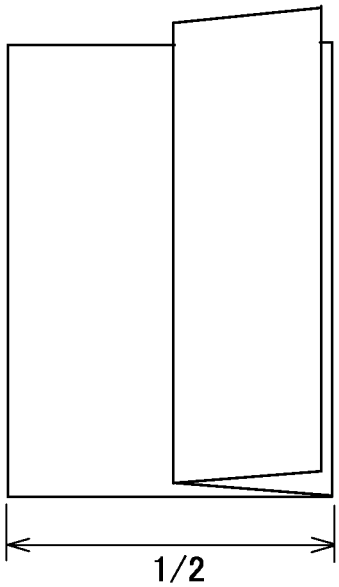

Next explanation will be made to a sheet folding process by the above mentioned folding part 48, referring to FIG. 21. The sheet formed with an ordinary image is often performed with two-fold or three-fold because of a letter finish. The three-fold has cases of an outer three-fold and an inner three-fold. FIG. 21(*a*) is an inner three-fold, FIG. 21(*b*) is an outer three-fold and FIG. 21(*c*) is a Z-fold.

In the case of the two-fold, the sheet sent to the second transport path 33 is folded at a ½ position of a sheet size by the first, second rolls 41*b*, 49, leaving a blank at the ½ position of the sheet size or the blank at the sheet end (primary folding).

In the case of the three-fold, the sheet sent to the second transport path 33 is folded at a ⅓ position of the sheet size by the first, second rolls 41*b*, 49 (primary folding). This folded sheet is folded by the second, third rolls 49, 50, and the remaining sheet is folded at the ⅓ position (secondary folding), and is sent to the first sheet discharging path 36.

Further, in the case of the three-fold, when performing the inner three-fold as shown in FIG. 21(*a*), the sheet sent to the second transport path 33 is folded at the ⅓ position of rear end side by the first, second rolls 41*b*, 49, and subsequently folded at the ⅓ position of front end side.

Similarly, as shown in FIG. 21(*b*), in the case of the outer three-fold, the sheet sent to the second transport path 33 is folded at the ⅓ position of front end side by the first, second rolls 41*b*, 49, and subsequently folded at the ⅓ position of rear end side.

Furthermore, in the case of the three-fold, when performing the Z-fold as shown in FIG. 21(*c*), the sheet sent to the second transport path 33 is folded at the ¼ position of rear end side by the first, second rolls 41*b*, 49, and subsequently folded at a ½ position of the sheet.

There is such a case of widening a folding width of the three-fold meeting a size of an envelope, leaving a blank margin. In a case of the inner three-fold, a side moving backward a little than the ⅓ position of the sheet size is folded (primary folding), and subsequently the front side of the sheet is folded at a position of the same width as that of the sheet primarily folded (secondary folding).

Similarly, in the case of the outer three-fold, a side moving forward a little than the ⅓ position of the sheet size is folded, and subsequently the rear side of the sheet is folded at a position of the same width as that of the sheet primarily folded (secondary folding). In short, when leaving a blank margin, folding is performed so that the side of the secondary folding is made longer.

[Control Means]

A control means 95 for performing the above sheet folding is composed as follows. A control CPU is mounted on the sheet folding device B, or a controller 91 of the image forming device A is provided with a folding controller. This controller is structured so that a following operation is enabled.

At first, a stopper (not shown) regulating positions of the sheet front end is provided in the first switchback path 34 and the second switchback path 35 of the second transport path 33, or a sensor means (shown S1, S2) detecting positions of the sheet front end is provided.

In the shown device, the first switchback path 34 has a first sensor S1, and the second switchback path 35 has a second sensor S2. The control means 95 is structured to calculate a timing of the crease position of the sheet reaching a set position by means of information of sheet size sent from the image forming device A and a detecting signal from the sensor S1 (S2).

Figure 22:
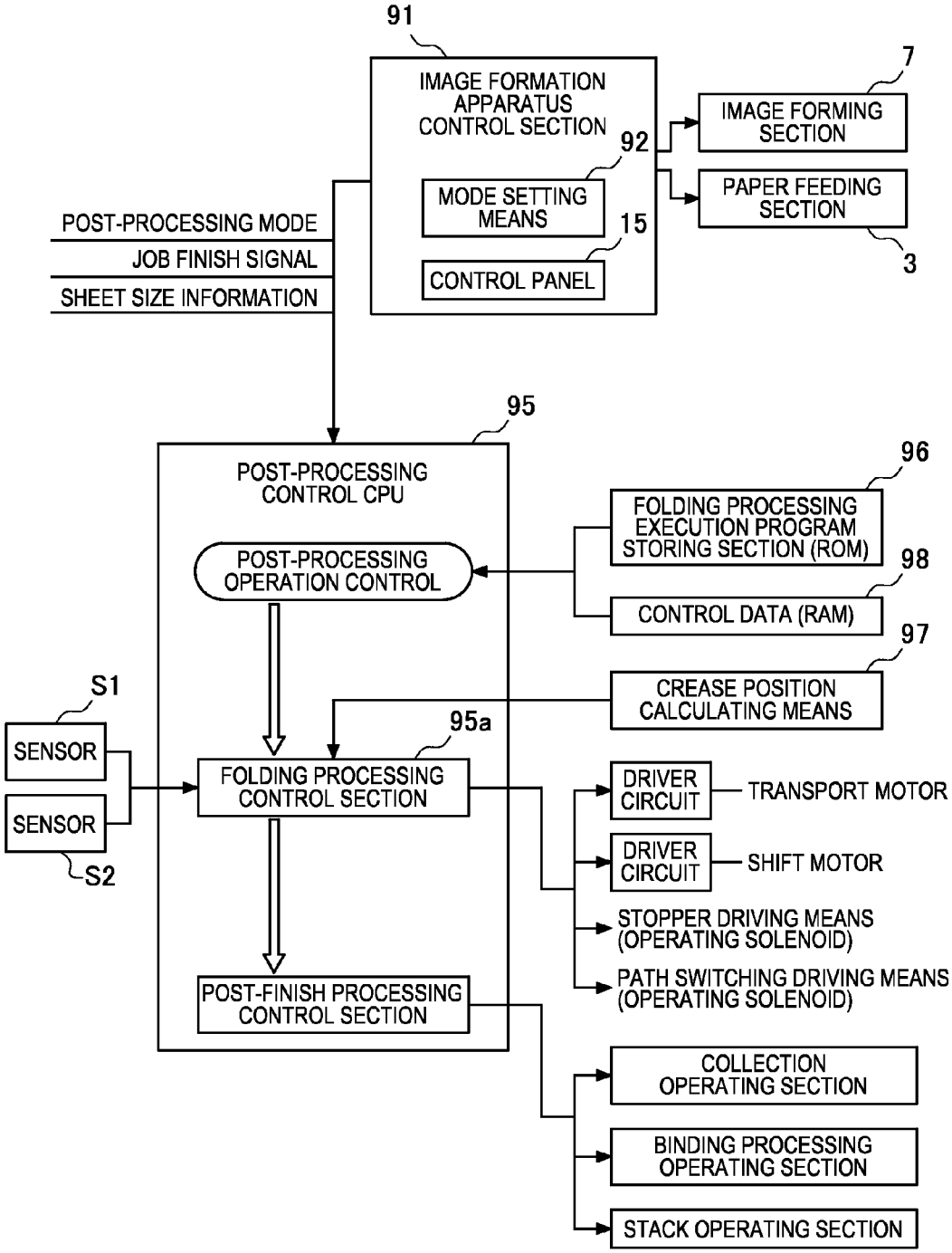
FIG. 22 An explanatory view of a control structure of the system in FIG. 1.
Figure 23:
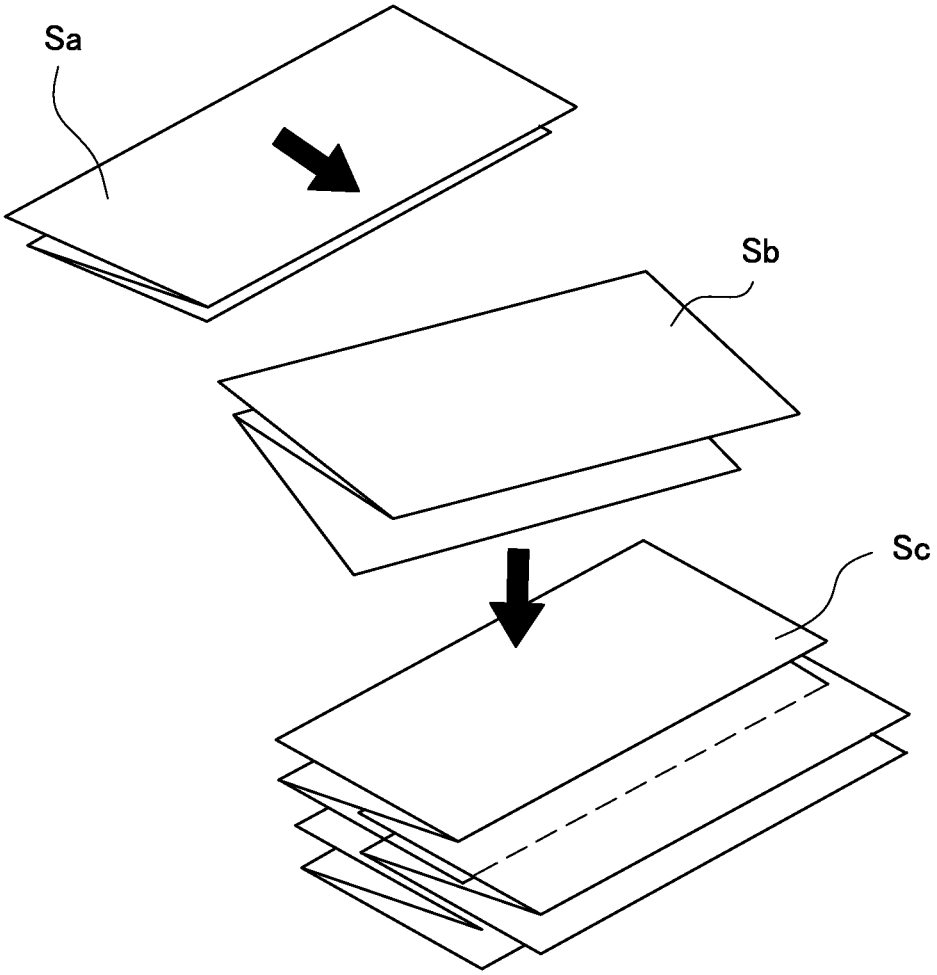
FIG. 23 An explanatory view of the condition of the sheet accommodating part in the prior art device.

Explanation will be made with reference to FIG. 22. In the image forming device A, the control CPU 91 is provide with a control panel 15 and a mode setting means 92. The control CPU 91 controls a sheet feeding section 3 and an image forming section 7 in response to an image forming condition set by the control panel 15.

The control CPU 91 transfers data and command necessary to post-processing such as "post-processing mode", "job finish signal" or "sheet size information" to the control section 95 of the post-processing device C.

The control section 95 of the post-processing device C is the control CPU, and has a folding processing control section 95*a*. To the control CPU 95, detecting signals of a first sensor S1 and a second sensor S2 are transferred. The control CPU 95 transfers control signals of "ON" and "OFF" to a path switching means 63.

This control CPU 95 memorizes in ROM 96 a carrier motor Mf (not shown), a shift motor MS (not shown) and a folding execution program of controlling a path switching means 63 in order to execute the above mentioned folding specification. RAM 98 memorizes data for calculating sheet crease in a crease position calculating means 97 and operation timing of a shift motor MS.

The crease position calculating means 97 is composed of an arithmetic circuit of calculating the crease position (size) from "sheet length size", "folding specification" and "blank margin" and from the sheet front end (front end in the sheet discharging direction). For example, in the two folding mode, the sheet is folded at the ½ position in the sheet discharging direction or folded at the ½ position, leaving a pre-set blank margin.

The calculation of the crease position is executed by [{(sheet length size)−(blank margin)}/2]. Further, in the three-fold mode, the crease position is calculated in response to the folding specification, for example, by the letter folding (inner three-fold, outer three-fold) or a filing folding (Z-fold, outer three-fold).

[Folding Operation]

Figure 16A:
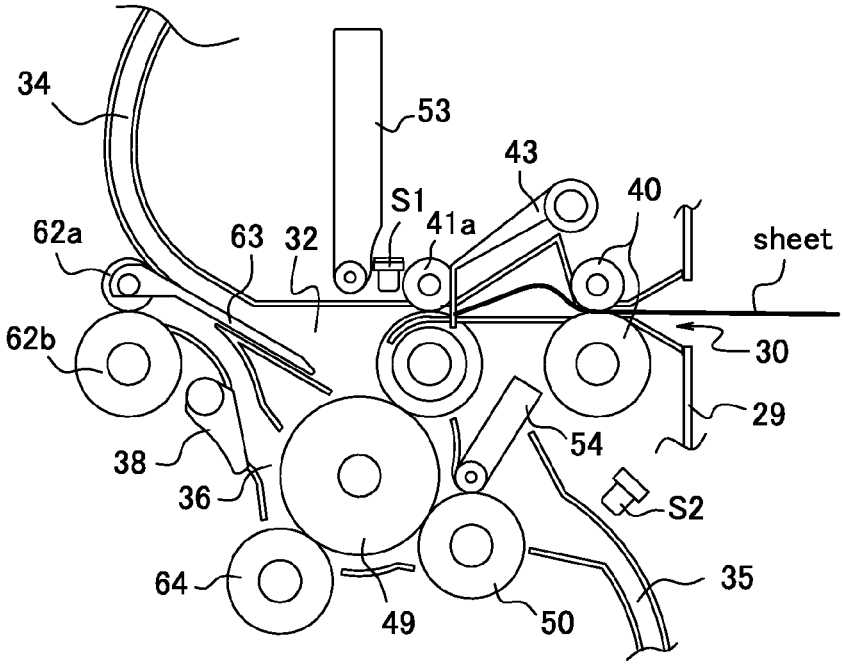
FIG. 16 Explanatory views of folding the sheet in FIG. 3, and (a) showing resist correction, and (b) showing the sheet taken in the first switchback path.
Figure 16B:
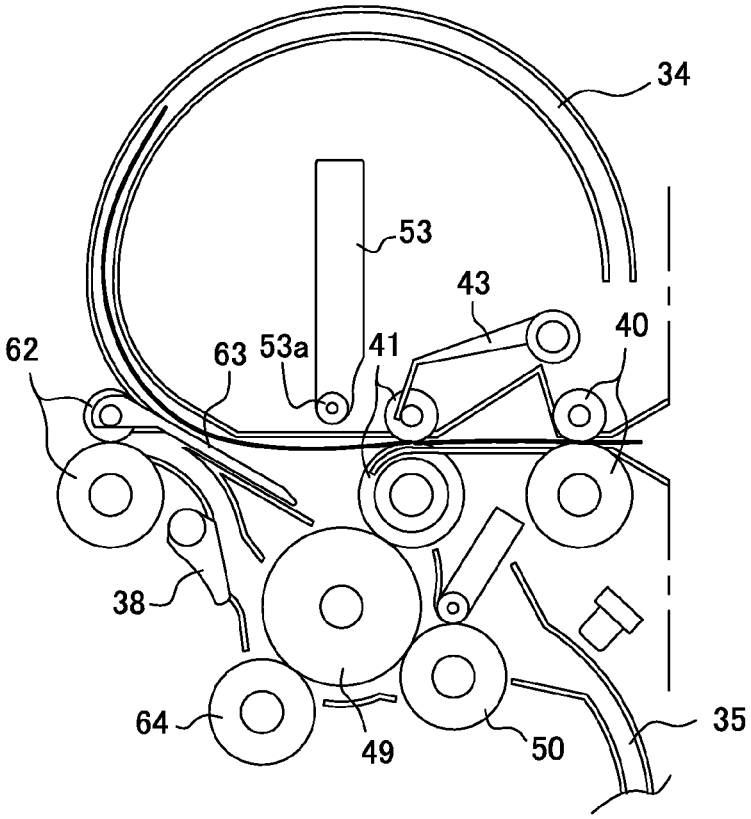
Figure 17A:
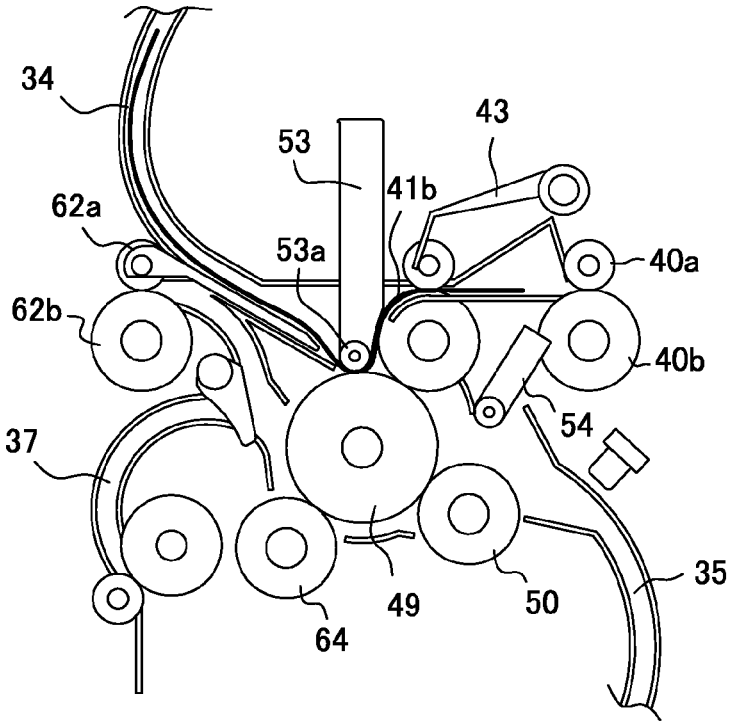
FIG. 17 Explanatory views of folding the sheet in FIG. 3, and (a) showing primary folding of the sheet with a first nipping part, and (b) showing the sheet effected with primary folding taken in the second switchback path.
Figure 17B:
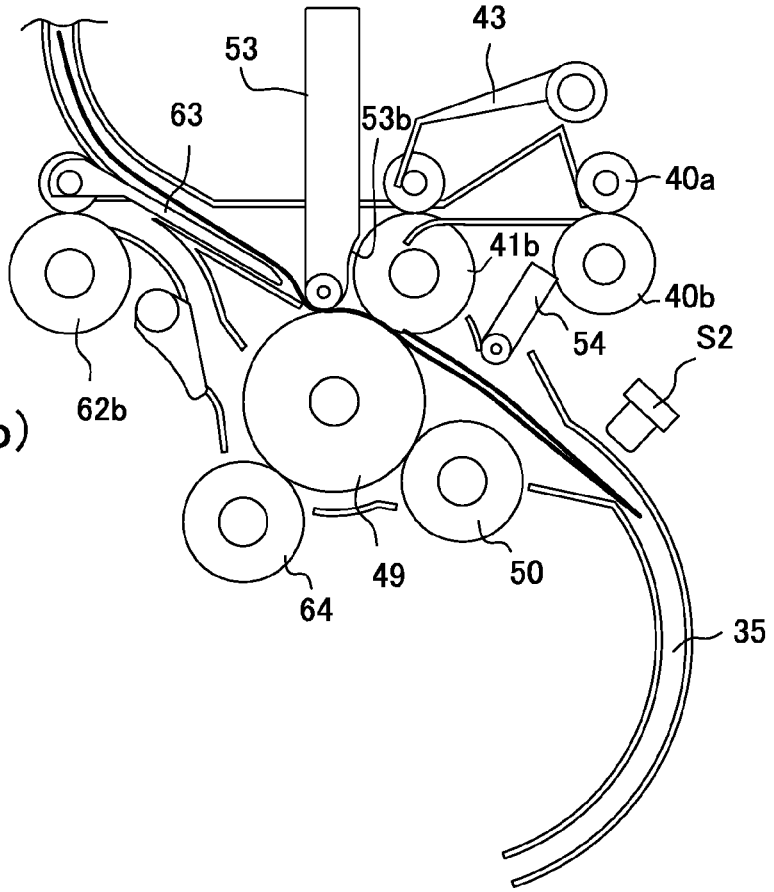

The above mentioned sheet folding device B will be explained in regard to operation of the structure thereof. FIG. 16(*a*) shows a condition of resist-correcting the sheet entering into the carry-in port 30, and FIG. 16(*b*) shows a condition of the sheet entering into the first switchback path 34 for executing the primary folding. FIG. 17(*a*) shows a sheet folding condition in the first folding part Np1, FIG. 17(*b*) shows a condition of the sheet entering into the second switchback path 35, FIG. 18(*a*) shows a sheet folding condition in the second folding part Np2, and FIG. 18(*b*) shows a condition of discharging the sheet.

In FIG. 16(*a*), the sheet is guided to the carry-in port 30 and sent to the downstream side by the pair of carry-in rollers 40. Then, the sheet is engaged at its front end by a stopper member 43, curved in loop, and is regulated at the front end.

In FIG. 16(*b*), when a stopper 43 retreats from the first transport path 32, the sheet is sent to the downstream side along the first transport path 32 by the sheet transporting mechanism. The control means 95 controls a path switching means 63 to guide the sheet from the first transport path 32 to the first switch back path 34.

Then, the sheet is transferred into the first switchback path 34 by a pinch roller 41*a* and a first roll 41*b*. In the first transport path 32, a first sensor S1 is disposed at the downstream side of the pinch roller 41*a* and the first roll 41*b* for detecting the front end of the sheet entering into the first switchback path 34.

In FIG. 17(*a*), based on a signal detecting the sheet front end by the first sensor S1, the control means 95 moves the hoist member 53*c* of the first folding deviating member 53 from the waiting position to the operating position at timing of sending the sheet crease position to a set position.

At this time, the sheet on the first transport path 32 is deformed in V shape toward the first folding part Np1. When a following roller 53*a* provided to the hoist member 53*c* contacts the periphery of the second roll 49, the sheet front end is drawn out in an opposite direction (rotating direction of the second roller).

On the other hand, the sheet rear end is drawn in the first folding part Np1 by transferring force of the first roll 41*b*. Then, the curving guide face of curving guide 53*b* regulates the sheet to follow the roller periphery of the first roll 41*b*.

Accordingly, the sheet is drawn into the first folding part Np1 at the front end side by the following roller 53*a* and at the rear end side by the pinch roller 41*a* and the first roll 41*b*, and the hoist timing of the hoist member 53*c* calculates the crease position.

Therefore, with respect to a sheet moving speed by the pinch roller 41*a* and the first roll 41*b* as well as a timing (particularly, timing at which the following roller 53*c* comes into contact with the periphery of the second roll 49) of moving the following roller 53*a* from the waiting position to the operating position, the control means 95 determines optimum values thereof in advance by experiments.

Synchronizing with moving of the following roller 53*a* from the waiting position to the operating position, the curve face of the curving guide 53*b* guides the sheet as following the periphery of the opposite first roll 41*b*, and therefore the crease position of the sheet does not change each time.

In FIG. 17(*b*), at the first folding part Np1, the sheet folded at the ½ position (two-fold), the ⅓ position (three-fold) and the ¼ position (three-fold) is imparted with transporting force at the first folding part Np1 and sent to the downstream side.

Therefore, the control means 95 positions the hoist member 54*c* of a second folding deviating member 54 at the operation position at the two-folding mode, and positions it at the waiting position at the three-folding mode. FIG. 17(*b*) shows the control of the three-folding mode. At the two-fold, the hoist member 54*c* is positioned at the operating position, guides the folded sheet from the front end to the second folding part Np2, and sends the folded sheet to the carrying-out port 31.

At the three-folding mode, the control means 95 positions the hoist member 54*c* of the second folding deviating member 54 at the waiting position as shown in FIG. 17(*b*). Then, the sheet from the first folding part Np1 is sent at its front end to the second switchback path 35, and the second sensor S2 detects the sheet front end (crease position).

Figure 18A:
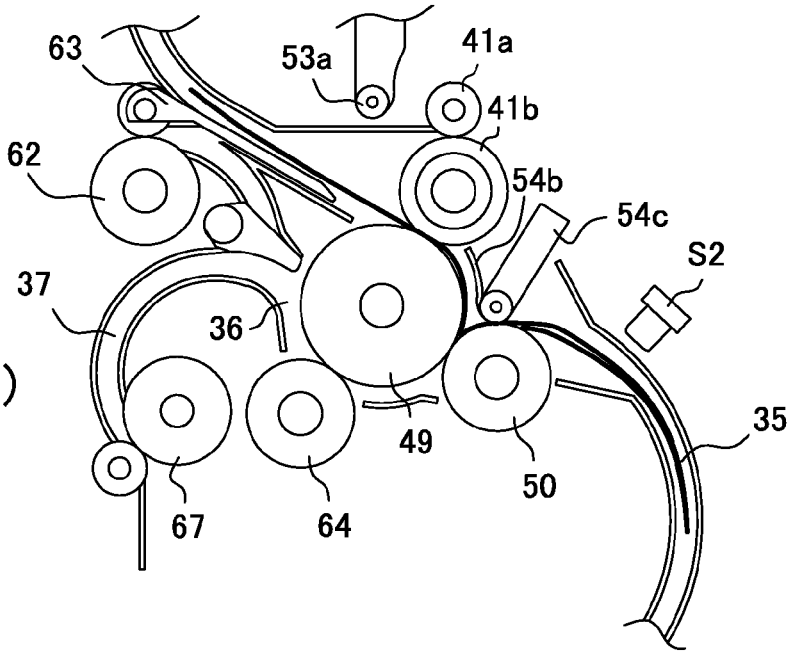
FIG. 18 Explanatory views of folding the sheet in FIG. 3, and (a) showing the sheet folded at a second nipping part from the second switchback path, and (b) showing the sheet folded at a second nipping part to be taken out in the sheet discharging direction.
Figure 18B:
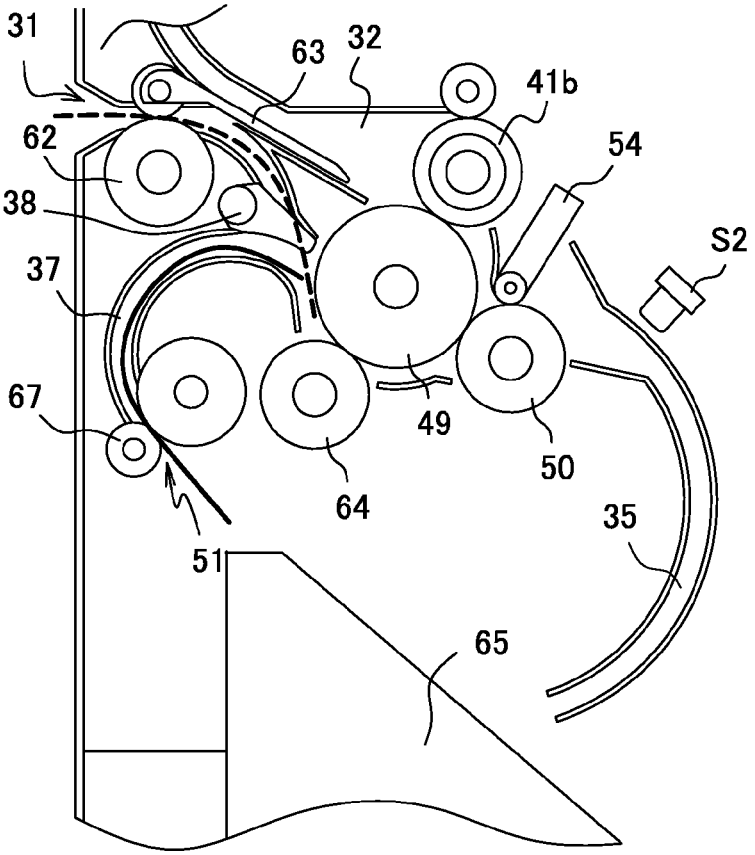
Figure 19:
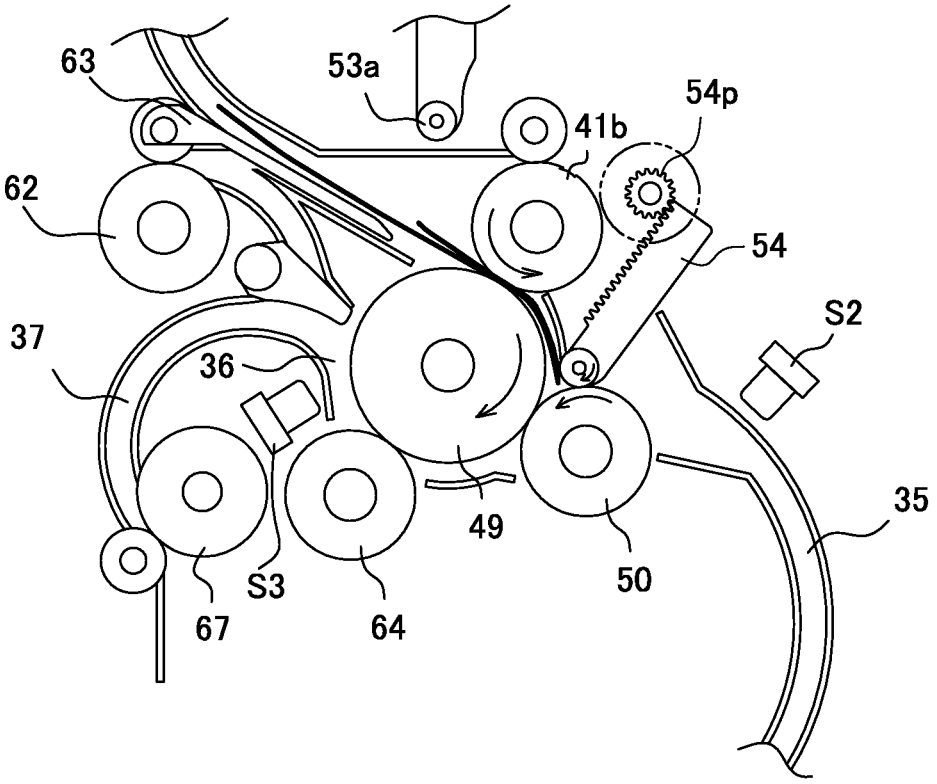
FIG. 19 An explanatory view of the sheet folding operation, showing the function of a second folding deviating member of guiding the sheet at its front end to a second nipping part when executing the two-fold mode.

In FIG. 18(*a*), upon the stage that the secondary crease position enters a fixed position on the basis of the detecting signal of the second sensor S2, the control means 95 moves the hoist member 54*c* of the second folding deviating member 54 from the waiting position to the operating position. Then, the sheet within the second switchback path 35 is drawn out in the opposite direction in a stage that the following roller 54*a* contacts the periphery of the third roll 50.

Thereby, the following roller 54*a* sends the sheet at its front side, and the first folding part Np1 sends the sheets at its rear side in the opposite direction and guides to the second folding part Np2.

In this case, the timing of the hoist member 54*c* moving from the waiting position to the operating position is the same as the case of the above mentioned first folding deviating member 53, and the action of the guide member 54*b* is also the same.

In FIG. 18(*b*), the folded sheet sent to the second folding part Np2 is exactly folded on its crease by a folding enhancement roller 64 contacting under pressure the second roll 49, and sent to the first sheet discharging path 36. Then, the control means 95 sends this folded sheet to the second sheet discharging path 37, following a predetermined sorting specification, or returns back to the first transport path 32.

In the case of the inner three-fold or the outer three-fold of the letter folding specification not requiring binding by the post-processing device C, the shown device controls a path switching flapper 38, and guides it from the second sheet discharging path 37 to the accommodating stacker 65.

Further, in the cases of the two-fold requiring the post-processing as filing or bookbinding, or the three-fold mode such as the ¼ Z folding, the sheet is moved from the first sheet discharging path 36 to the first transport path 32, and is sent from the carrying-out port 31 to the post-processing device C.

[Operation of Two-Folding Mode]

Figure 20:
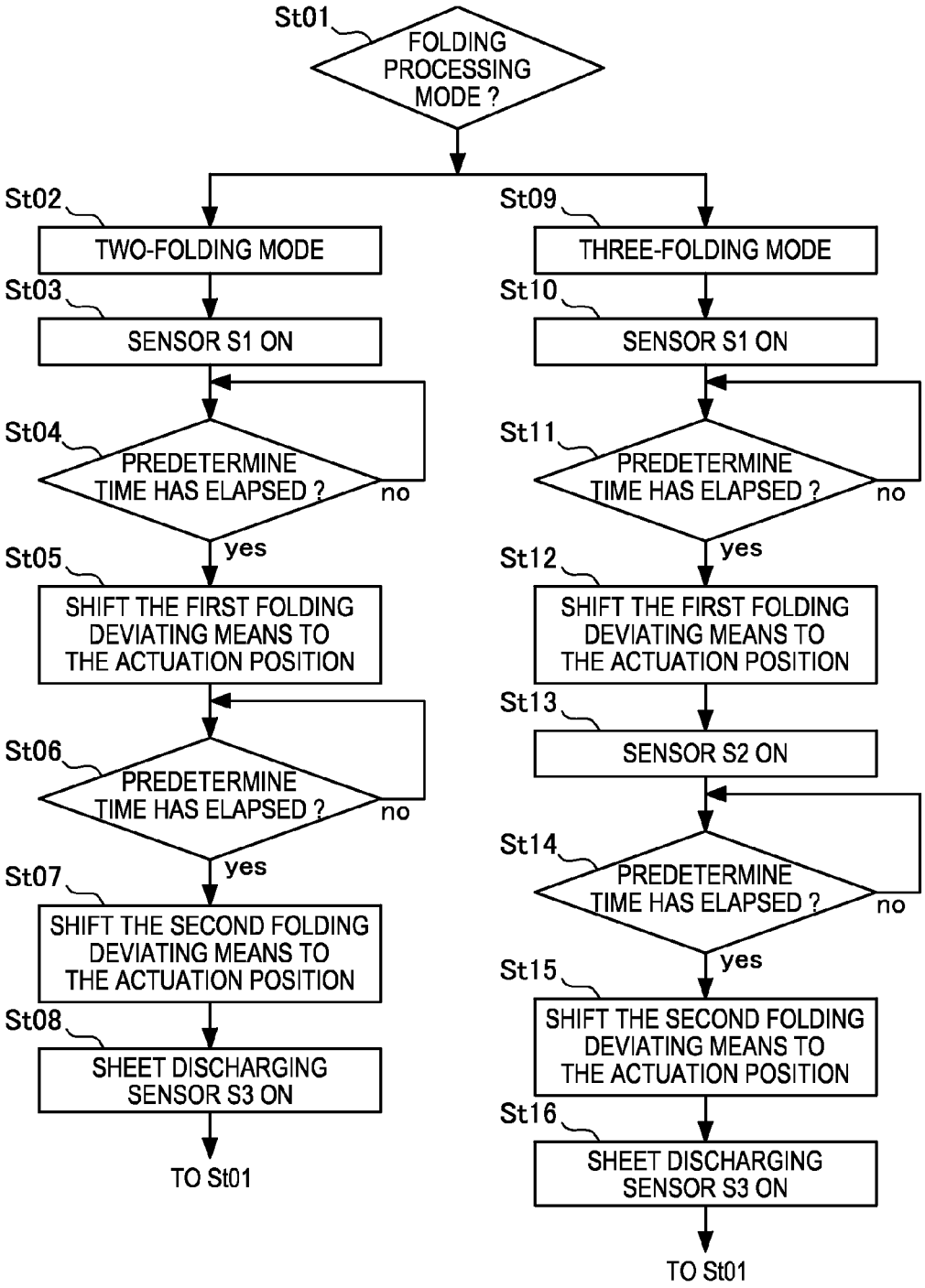
FIG. 20 A flow chart showing the folding operation in the sheet folding device in FIG. 3.

In the mode of two-folding the sheet of the above folding operation, a mode indicating signal as to whether or not processing the fold at the same time as the sheet discharging signal is received from the image forming device A as shown in FIG. 20. Then, the control means 95 calculates the crease position by a crease position calculating means 97 (St01).

At the time of the two-fold mode (St02), the first sensor S1 detects the sheet front end, the control means 95 detects the front end of the sheet with the first sensor S1 (St03). From this detecting signal, after passing (St04) of a time of sending the sheet corresponding to the length of the sheet calculated by the crease position calculating means 97 (St05), the first folding deviating member 53 is moved from the waiting position to the operating position. This moving is controlled by rotation of a shift motor MS.

In the course of the hoist member 53*c* of the first folding deviating member 53 moving to the operating position, as having explained in FIG. 17(*a*), the sheet of the first transport path 32 is distorted toward the first folding part Np1 on the basis of the crease position. When the following roller 53*a* of the first folding deviating member 53 contacts the periphery of the second roll 49, the sheet is pulled and inserted into the first folding part Np1 from the crease position.

Then, in the two-fold mode, the control means 95 moves (St07) the second folding deviating member 54 to the operating position on the basis of the detecting signal from the first sensor S1 after estimated time (St06) of inserting the sheet crease into the first folding part Np1.

This estimated time is set before a time when the crease position of the sheet is inserted into the first folding part Np1 and the front end of the folded sheet reaches the curving guide 54*b*. Therefore, the front end of the folded sheet is guided by a curved guide face of the curved guide 54*b* and follows the second roller periphery.

At the same time as the above mentioned, since the following roller 54*a* placing at the operating position follows rotation of a third roll 50, even if the sheet front end is curled in a direction of escaping in a direction from the second folding part Np2, it is exactly guided in the second folding part Np2 by rotation of the following roller 54*a* and the third roll 50.

The control means 95 transports the folded sheet sent from the second folding part Np2 to the first discharging path 36, from the first discharging path 36 to the first transport path 32. The control means 95 prepares for processing a succeeding sheet under a condition of placing the second folding deviating member 54 at the operating position (St08).

In the drawing, since the first folding deviating member 53 is placed at the waiting position, reciprocally, the second folding deviating member 54 is placed at the operating position, and it is also possible to move the second folding deviating member 54 to the waiting position by a detecting signal of the sheet discharging sensor S3 disposed in the first discharging path 36.

[Operation of Three-Folding Mode]

In the mode of three-folding the sheet of the above folding operation, a mode indicating signal as to whether or not processing the fold at the same time as the sheet discharging signal is received from the image forming device A as has explained in FIGS. 16 to 18. Then, the control means 95 calculates the crease position by a crease position calculating means 97 (St01). At the time of the three-fold mode (St09), the sensor S1 detects the front end of the sheet (St10).

From this detecting signal, after passing (St11) of a time of sending the sheet corresponding to the length of the sheet calculated by the crease position calculating means 97 (St12), the first folding deviating member 53 is moved from the waiting position to the operating position. This moving is controlled by rotation of a shift motor MS.

In the course of the hoist member 53*c* of the first folding deviating member 53 moving to the operating position, as having explained in FIG. 17(*a*), the sheet of the first transport path 32 is distorted toward the first folding part Np1 on the basis of the crease position. When the following roller 53*a* of the first folding deviating member 53 contacts the periphery of the second roll 49, the sheet is pulled and inserted into the first folding part Np1 from the crease position. At the time of the three-fold mode, the control means 95 waits that the second sensor S2 detects the front end of the sheet (St13).

On the basis of the signal detected by the second sensor S2, after estimated time (St14) of the secondary folding position of the sheet reaching the determined position, the control means 95 moves the second folding deviating member 54 to the operating position (St15). This estimated time is set by a calculated value of the crease position calculating means 97.

Then, the sheet is given transporting force by the following roller 54*a*, and is inserted into the second folding part Np2. The sheet discharging sensor S3 detects the sheet at its front end, and in response to the folding specification, the sheet discharging sensor S3 discharges the sheet from the first sheet discharging path 36 to the first transport path 32, or discharges from the second sheet discharging path 37 to the accommodating stacker 65 (St16).

By the way, if, at the step St01, a post-processing mode of not folding the sheet is set from the mode setting means 92, this sheet is sent toward the pair of discharging rollers 62.

[Structure of Sheet Discharging Path]

The two-folded or three-folded sheet is sent to the first sheet discharging path 36 from a pressing contact point of a second or third rolls 49, 50. The sheet is performed with folding by the folding enhancement roller 64 contacting under pressure the second roll 49, and guided to the first sheet discharging path 36. This first sheet discharging path 36 is, as above mentioned, joined to the first transport path 32. The second sheet discharging path 37 branched from the first sheet discharging path 36 communicates via the path switching flapper 38, and this second sheet discharging path 37 guides the folded sheet to the accommodating stacker 65 disposed under the second transport path 33.

Therefore, the sheets not needed to be sent to the post-processing device C, for example, the sheet folded in the specification for the letter such as the inner three-fold or outer three-fold are accommodated in the stacker 65, not sent to the carrying-out port 31.

Among the folded sheets sent to the first sheet discharging path 36, the sheets to be moved to the post-processing device C for post-processing are moved to the carrying-out port 31 by the pair of discharging rollers 62.

By the way, in this case, decision to post-processing or not decides the post-processing at the same time as the image forming condition by, for example, the above mentioned control panel 15. In response to a determined finishing condition, it decides to send the sheets to the accommodating stacker 65 or to the post-processing device C.

[Image Forming Device]

The image forming device A has a following structure as shown in FIG. 1. This device sends the sheet from a sheet supply part 3 to an image forming part 7, and after printing the sheet by the image forming part 7, the device takes out the sheet from the sheet discharging port 18. The sheet supply part 3 accommodates the sheets of various sizes in sheet supply cassettes 4*a*, 4*b*, and separates the designated sheets one by one, and sends to the image forming part 7.

The image forming part 7 is arranged with, for example, an electrostatic dram 8, a print head (laser luminous organ) 9 disposed around it, a developing machine 10, and a transcribing chargers 11 and 12. An electrostatic latent image is formed on the electrostatic dram 8 by the laser luminous organ 9, adhered with a toner by the developing machine 10, transcribed on the sheet by the transcribing charger 11, and is heat-fixed by a fixer 12.

The thus image formed sheets are transferred in succession from the sheet discharging port 18. Numeral 13 is the circulating path of printing on both sides, that is, the sheet printed on the surface side by the fixer 12 is turned reversely inside and outside, and after then this is again sent to the image forming part 7 to be printed on the inside face. The sheet printed on both sides is turned reversely inside and outside, and taken out from the sheet discharging port 18.

Numeral 20 designates a document reading part, and a scan unit 22 scans a document sheet set on a platen 21, and a not shown photoelectric conversion element reads it electrically. This image data is, for example, digital-processed at an image processing part, transferred to a data memory 16, and sends an image signal to the laser luminous organ 9. Numeral 25 is a feeder for sending the document sheet accommodated in the stacker 26 to the platen 21.

The above structured image forming device A is provided with a not shown controlling part (controller), and is set from a control panel 15 with image forming conditions, for example, printing out designations of sheet sizes, color-monochrome, printing designation, printing number, one-side or both side printing, or enlarging or reducing printing.

On the other hand, the image forming device A is accumulated on the data memory 16 with the image data read by the scan unit 22 or image data transferred from outside networks, and from the data memory 16, the image data is transferred to a buffer memory 17 from which data signals are sent in succession to the printing head 9.

From the above control panel 15, inputting of post-processing conditions at the same time together with the image forming conditions are designated. For the post-processing conditions, "printing out mode", "staple binding mode" or "sheet bundle mode" are selected. For the post-processing conditions, the folding specification in the sheet folding device B is determined.

[Post-Processing Device]

Figure 2:
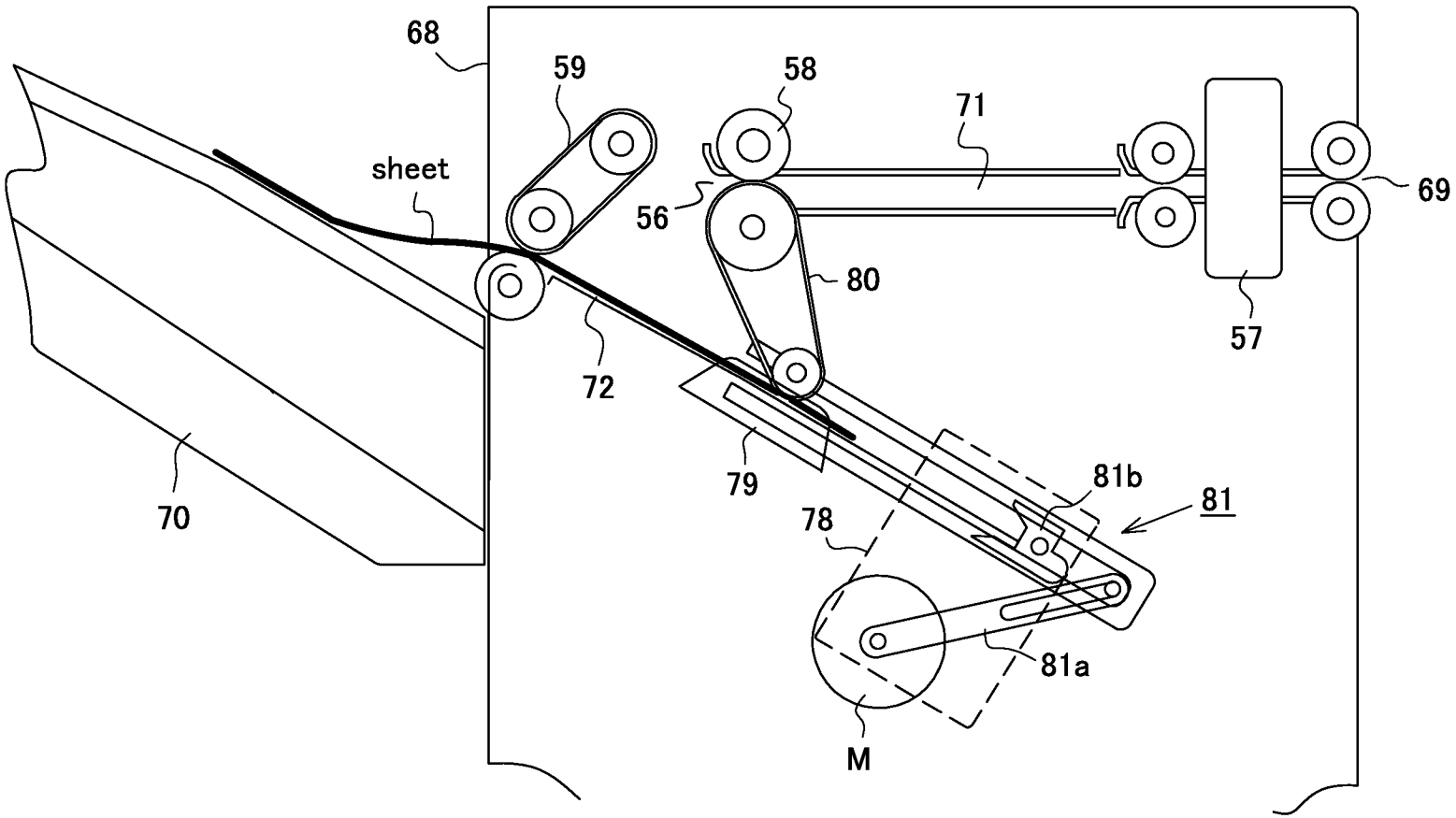
FIG. 2 An explanatory view of an enlarged principal part of a post-processing device in the system of FIG. 1.

The post-processing device C has following structures as shown in FIG. 2. This device has, in a device housing 68, a sheet receipt port 69, a sheet discharging stacker 70 and a post-processing path 71. The sheet receipt port 69 is connected to the carrying-out port 31 of the sheet folding device B for receiving the sheets from the first transport path 32 or the first sheet discharging port 36.

A post-processing path 71 is structured for guiding the sheet from the sheet receipt port 69 to the sheet discharging stacker 70, and in this path, a processing tray 55 is provided. Numeral 56 is a sheet discharging port which accumulates the sheets from the post-processing path 71 into the processing tray 55.

Numeral 57 is a punch unit disposed in the post-processing path 71. The sheet discharging port 56 is disposed with a sheet discharging roller 58 which accumulates the sheets from the sheet receipt port 69 into the processing tray 55 arranged at the downstream side.

The processing tray 55 transfers by switchback (turning over transferring direction) the sheets from the post-processing path 71 to perform the set copies-justification by a post-end regulating member (not shown) provided on the tray. Therefore, above the tray, a reversely changing roller 59 is furnished for switching back the sheets from the sheet discharging port 56.

The processing tray 55 communicates with the sheet discharging stacker 70, and supports the sheets from the sheet discharging port 56 at its front end side by the sheet discharging stacker 70 and at the rear end side by the processing tray 55 (bridge support).

The processing tray 55 is arranged with a stapler unit 78 for binding sheet bundles positioned by a rear end regulating member. Numeral 79 designates a registering means for carrying out width-end registration to the sheets brought on the processing tray in the direction crossing with transportation. Numeral 80 is a paddle rotating body connected to the rotating shaft of the sheet discharging roller 58 for sending the sheet from the sheet discharging roller 58 to the rear end regulating member.

Numeral 81 is a sheet bundle discharging means for sending the sheet bundle bound by a stapler unit 78 to the sheet discharging stacker 70. Therefore, the shown sheet bundle discharging means 81 is composed with a lever member 81*a* turnably supported at its base end portion and a sheet end engaging member 81*b*.

The sheet end engaging member 81*b* is furnished to the processing tray for reciprocating in the sheet discharging direction along the processing tray 55, and is connected to the lever member 81*a*. Reference mark "M" designates a driving motor for the lever member 81*a* to turnably move. The sheet discharging stacker 70 is furnished with an elevator mechanism (not shown) hoisting vertically in response to the sheet stacking amount.

This application claims priority from Japanese Patent Application No. 2011-088958 and Japanese Patent Application No. 2011-279749.

What is claimed is:

1. A sheet folding device, comprising a sheet transporting path of moving a sheet sent from a carry-in port to a carrying-out port, a folding path branched from the sheet transporting path, performing a folding processing of the sheet from the carry-in port, a folding part disposed in the folding path, folding to match the sheet, a sheet stacking part of stacking the folded sheets from the folding part, a sheet discharging path of discharging the folded sheet sent from the folding part to the sheet stacking part, and a guiding wall of guiding the folded sheet sent from the sheet discharging path to the sheet stacking part, and wherein the guiding wall is structured in a manner of guiding the folded sheet discharged in a first sheet discharging direction almost crossing with the direction of folding the sheet from the sheet discharging path, the sheet stacking part has a stacking face inclining in a manner that the downstream side in the second sheet discharging direction is lower than the upstream side in the second sheet discharging direction, the inclined stacking face is composed of a first supporting face of supporting the stacked sheet at its front part, and a second supporting face of supporting the stacked sheet at its rear part, the first supporting face has a registration part of regulating the sheet at its front end, and the length from one end to the other end is shorter than ½ of the sheet minimum size length, and the first supporting face is rotatably provided toward upward around a rotating shaft provided to the registration part.

2. A sheet stacking device, comprising a folding processing path of sending a sheet to a folding processing part, a folding processing means disposed at the folding processing part of performing the sheet folding processing, a sheet discharging path of transporting the sheet performed with the sheet folding processing at the folding processing part to the sheet stacking part in the downstream side, a sheet discharging means disposed at the sheet discharging path, discharging the folded sheet from an discharging port, and an accommodating stacker disposed at the sheet stacking part, dropping and accommodating the folded sheet on the stacking face having the sheet discharging port and a step, the accommodating stacker composed of the stacking face, an accommodating area of stacking and accommodating the sheet above the stacking face, a regulating face formed in the side wall of the accommodating area, colliding therewith the sheet front end in the discharging direction discharged from the sheet discharged by the sheet discharging means, and a guiding wall of dropping the folded sheet discharged from the sheet discharging port onto the stacking face from the sheet side end along the regulating face, blade members of colliding to regulate the sheet end dropping toward the stacking face from the sheet discharging port, shaft supporting members of rotatably supporting the blade members in the dropping direction, and a braking member of reducing rotation speed of the blade members.

3. The sheet stacking device as set forth in claim 2, wherein the blade members are composed of plural blade plates rotatably supported at basic portions, and each of blade plates has a plane shape engaging with an end face of folded sheet dropping from the sheet discharging port onto the stacking face.

4. The sheet stacking device as set forth in claim 3, wherein the accommodating stacker has side walls opposing each other at spaces being larger than a maximum folding width of the folded sheet, and the blade members are furnished to the shaft supporting members rotatably supported between the opposing side walls.

5. The sheet stacking device as set forth in claim 2, wherein the guide wall is disposed within an accommodating area in the downstream side of the paper discharging port, and have the guide face of inclining the folded sheet discharged from the sheet discharging port to drop the sheet in the direction crossing with the sheet discharging direction.

6. The sheet stacking device as set forth in claim 5, wherein the guiding face is composed of an inclining face of guiding the folded sheet discharged from the sheet discharging port to the regulating face.

7. The sheet stacking device as set forth in claim 4, wherein the braking means is composed of a braking shoe sliding at least one of the blade members and/or the shaft supporting members.

8. The sheet stacking device asset forth in claim 7, wherein the braking means is composed of the braking shoe and a biasing means giving compression force.

9. The sheet stacking device as set forth in claim 2, wherein the accommodating stacker has the stacking face of stacking and accommodating the folded sheets from the sheet discharging port, and the registration part of colliding the accommodated and folded sheets at the end faces with the stacking face, the stacking face is composed of the inclining face inclining to collide the stacked sheets at the ends with the registration part, and the blade members are disposed upward of this inclining face.

10. A sheet folding device, having a folding processing path of folding a sheet and sending to a folding processing part, a folding processing means disposed at the folding processing part and performing to fold the sheet, a sheet discharging path of transporting the sheet performed with the folding processing at the folding processing part to a sheet stacking part in the downstream side, a sheet discharging means disposed in the sheet discharging path, transporting the folded sheet from the sheet discharging port, and an accommodating stacker disposed in the sheet stacking part, dropping the folded sheet onto the stacking face stepwise in regard to the sheet discharging port, wherein the folding processing means is composed of a folding roll mechanism of carrying out a primarily folding on the sheet sent from the folding processing path, and subsequently a secondarily folding thereon, the sheet discharging path accommodates the sheets performed with the folding processing in the accommodating stacker, the accommodating stacker is composed of a stacking face, an accommodating area of stacking and accommodating the sheets above the stacking face, a regulating face formed in a side wall of the accommodating area, and colliding the folded sheets at the front ends discharged from the discharging port by the sheet discharging means, a guiding wall of dropping the folded sheets at the sheet side end crossing in the sheet discharging direction, the folded sheets being transported from the sheet discharging port onto the stacking face, following the sheet front ends along the regulating face, and having the blade members of colliding to regulate the sheets at the ends dropping from the sheet discharging port toward the stacking face, shaft supporting members of rotatably supporting the blade members in the dropping direction, and a braking means of reducing rotation speed of the blade members.

* * * * *